US007681506B2

(12) United States Patent
Forbes et al.

(10) Patent No.: US 7,681,506 B2
(45) Date of Patent: Mar. 23, 2010

(54) TRUCK BOLSTER

(75) Inventors: James W. Forbes, Campbellville (CA); Tomasz Bis, Ancaster (CA)

(73) Assignee: National Steel Car Limited (CA)

( * ) Notice: Subject to any disclaimer, the term of this patent is extended or adjusted under 35 U.S.C. 154(b) by 1058 days.

(21) Appl. No.: 11/153,913

(22) Filed: Jun. 16, 2005

(65) Prior Publication Data

US 2006/0283351 A1 Dec. 21, 2006

(51) Int. Cl.
*B61F 1/00* (2006.01)

(52) U.S. Cl. ..... 105/226

(58) Field of Classification Search ..... 105/226, 105/228, 230, 157.1, 227
See application file for complete search history.

(56) References Cited

U.S. PATENT DOCUMENTS 632,426 A 9/1899 Player
709,071 A 9/1902 Adams
768,901 A 8/1904 Hopkins
816,010 A 3/1906 Goodwin
826,025 A 7/1906 Dodds
831,251 A 9/1906 Stucki
941,691 A 11/1909 Anderson
1,031,276 A 7/1912 Lamont
1,039,883 A 10/1912 Barber et al.
1,316,553 A 9/1919 Barber
1,403,588 A 1/1922 Canfield et al.
1,410,979 A 3/1922 Westlake
1,555,691 A 9/1925 Miyasaki
1,628,839 A 5/1927 Haskell
1,713,059 A 5/1929 Stertzbach
1,751,065 A 3/1930 Alden
1,852,393 A 4/1932 Barrows
1,873,055 A 8/1932 Sherman (Continued)

FOREIGN PATENT DOCUMENTS

CA 0316518 10/1931

(Continued)

OTHER PUBLICATIONS

1937 Car Builders Cyclopedia pp. 892-893.

(Continued)

*Primary Examiner*—S. Joseph Morano
*Assistant Examiner*—Robert J McCarry, Jr.
(74) *Attorney, Agent, or Firm*—Hahn Loeser & Parks LLP; Michael H. Minns

(57) ABSTRACT

A railroad car truck bolster may be formed as a steel casting. That bolster may include side bearing fitting access sockets located abreast of the side bearing seats. It may also include substantially continuous internal cavities to either side of a cross-wise internal vertical web plate mounted under the center plate bowl. The truck bolster may have large brake rod apertures that have large radii of curvature, and that may be bounded internally be a shear reinforcement at the vertical plane of the truck mid-span centerline, and another shear reinforcement spaced laterally outboard of the mid-span vertical plane. The webs of the bolster may be substantially imperforate outboard of the brake rod openings. The brake rod openings may have a profile that is large enough to accept either conventional or Wabco brake rods. The end portions of the truck bolster may include bolster pockets that have both primary and secondary wedge angles.

42 Claims, 13 Drawing Sheets

U.S. PATENT DOCUMENTS

| | | | | | |
|---|---|---|---|---|---|
| 1,912,563 | A | | 6/1933 | Allison | |
| 1,916,141 | A | | 6/1933 | Hedgcock | |
| 1,969,131 | A | | 8/1934 | Hedgcock et al. | |
| 1,971,768 | A | | 8/1934 | Chiles | |
| 2,065,454 | A | | 12/1936 | Hammerstrom | |
| 2,245,272 | A | | 6/1941 | Hammerstrom | |
| 2,324,267 | A | | 7/1943 | Oelkers | |
| 2,551,064 | A | | 5/1951 | Spenner | |
| 2,552,019 | A | | 5/1951 | Stertzbach | |
| 3,285,197 | A | | 11/1966 | Tack | |
| 3,680,490 | A | | 8/1972 | Wilson et al. | |
| 3,713,710 | A | | 1/1973 | Wallace | |
| 3,762,339 | A | | 10/1973 | Dwyer | |
| 3,771,465 | A | | 11/1973 | Glenn | |
| 4,114,540 | A | | 9/1978 | Strugielski et al. | |
| 4,179,995 | A | | 12/1979 | Day | |
| 4,196,672 | A | * | 4/1980 | Bullock | 105/230 |
| 4,230,047 | A | | 10/1980 | Wiebe | |
| 4,244,297 | A | | 1/1981 | Monselle | |
| 4,265,182 | A | | 5/1981 | Neff et al. | |
| 4,274,339 | A | | 6/1981 | Cope | |
| 4,311,098 | A | * | 1/1982 | Irwin | 105/226 |
| 4,332,202 | A | | 6/1982 | Amwake | |
| 4,342,266 | A | | 8/1982 | Cooley | |
| 4,351,242 | A | | 9/1982 | Irwin | |
| 4,370,933 | A | | 2/1983 | Mulcahy | |
| 4,413,569 | A | | 11/1983 | Mulcahy | |
| 4,434,720 | A | | 3/1984 | Mulcahy et al. | |
| 4,483,253 | A | | 11/1984 | List | |
| 4,491,075 | A | | 1/1985 | Neumann | |
| 4,579,065 | A | | 4/1986 | Zehnder | |
| 4,674,411 | A | | 6/1987 | Schindehutte | |
| 4,773,335 | A | | 9/1988 | Smith et al. | |
| 4,838,174 | A | | 6/1989 | Moehling | |
| 4,915,031 | A | | 4/1990 | Wiebe | |
| 4,924,779 | A | | 5/1990 | Curtis et al. | |
| 5,036,774 | A | | 8/1991 | Curtis et al. | |
| 5,046,431 | A | | 9/1991 | Wagner | |
| 5,046,866 | A | | 9/1991 | Mulcahy | |
| 5,111,753 | A | * | 5/1992 | Zigler et al. | 105/230 |
| 5,138,954 | A | | 8/1992 | Mulcahy | |
| 5,139,159 | A | | 8/1992 | Daugherty, Jr. et al. | |
| 5,174,218 | A | | 12/1992 | List | |
| 5,241,913 | A | | 9/1993 | Weber | |
| 5,463,964 | A | | 11/1995 | Long et al. | |
| 5,749,301 | A | | 5/1998 | Wronkiewicz et al. | |
| 5,752,564 | A | | 5/1998 | Callahan et al. | |
| 5,802,982 | A | | 9/1998 | Weber | |
| 5,806,435 | A | | 9/1998 | Pitchford | |
| 5,809,899 | A | | 9/1998 | Kaufhold et al. | |
| 5,954,114 | A | | 9/1999 | Bauer et al. | |
| 5,967,053 | A | | 10/1999 | Toussaint et al. | |
| 5,992,330 | A | | 11/1999 | Gilbert et al. | |
| 6,006,679 | A | | 12/1999 | Ahmadian et al. | |
| 6,089,166 | A | | 7/2000 | Callahan et al. | |
| 6,196,134 | B1 | | 3/2001 | Stecker | |
| 6,354,226 | B2 | | 3/2002 | Stecker | |
| 6,371,033 | B1 | | 4/2002 | Smith | |
| 6,622,776 | B2 | | 9/2003 | Bauer et al. | |
| 6,659,016 | B2 | | 12/2003 | Forbes | |
| 6,672,224 | B2 | | 1/2004 | Weber et al. | |

FOREIGN PATENT DOCUMENTS

| | | |
|---|---|---|
| CA | 0862467 | 2/1971 |
| CA | 2090031 | 6/1991 |
| GB | 2 150 899 A | 7/1985 |

OTHER PUBLICATIONS

1980 Car and Locomotive Cyclopedia, pp. 669-750-Section 13.

1997 Car and Locomotive Cyclopedia, 6th ed. (Omaha: Simmons-Boardman Books, Inc. 1997) at pp. 705-770. Section 7: Trucks Wheels Axles & Bearings.

AAR Manual of Standards and Recommended Practices Standard S-392.

International Search Report for PCT/CA2006/002096.

* cited by examiner

TRUCK BOLSTER

FIELD OF THE INVENTION

This invention relates to the field of rail road cars, and to bolsters for trucks for rail road cars.

BACKGROUND OF THE INVENTION

In railroad rolling stock it is known to employ trucks to support railroad car bodies during motion along railroad tracks. Commonly, a rail road car truck may have a pair of side frames, or side frame assemblies, that seat upon wheelsets, and a truck bolster that extends crosswise between, and is resiliently mounted to, the side frames. The bolster may typically have a centerplate bowl located at mid-span. The car body may include a centerplate that seats in the centerplate bowl in a relationship that permits a vertical load from the car body to be passed into the truck bolster while also permitting rotational pivoting of the bolster relative to the car body such that the truck can turn and the rail road car can negotiate curves in the track.

As a first approximation, at the simplest level of analysis, the truck bolster may be considered to be a simply supported beam. The car body and lading may be idealized as a vertically downward point load applied at the mid-span center of the beam. This point load is reacted by a pair of reactions, which may for initial approximation also be idealized as point loads, that act vertically upwardly at the beam ends, those reactions being provided by the main spring groups. The main spring groups have upper seats on the undersides of the ends of the bolster, and lower seats on the tension member of the side frames. Truck bolsters may tend to have the general form of a beam having a top flange, a bottom flange, and shear webs extending between the top and bottom flanges. The bending moment in the truck bolster may tend to be greatest at mid span. Consequently, the beam may tend to be deepest in section at the mid span location. While welded or riveted truck bolsters are known, truck bolsters tend commonly to be castings, most typically steel castings.

Truck bolsters may have side bearings mounted on their upper flanges some distance outboard from the centerplate. The side bearings receive vertical loads that are transmitted, typically, between a body bolster of the railroad car body, and the truck bolster. This may tend to occur most particularly when the car body is in a condition where it may lean to one side relative to the truck bolster. The side bearing may include a roller or a slider that permits this transfer of force to occur while also permitting a turning, or pivoting motion of the truck bolster relative to the body bolster. When the railroad car body is in a rocking or leaning condition, the vertical force transmitted into the side bearing, and hence into the bolster arm beneath the side bearing, can be quite substantial.

SUMMARY OF THE INVENTION

In a first aspect of the invention there is a truck bolster for a railroad freight car truck. The truck bolster is a casting. The truck bolster includes a beam having an upper flange portion, a lower flange portion, a first web portion and a second web portion, the upper and lower flange portions and the first and second web portions being outside walls of the beam defining a hollow box section. The beam has first and second ends for mounting to rail road car truck sideframes. A centerplate bowl is located at mid-span between the first and second ends. There is a shear transfer reinforcement mounted within the beam. A first portion of the shear transfer reinforcement is mounted to receive downward forces from the centerplate. A second portion of the shear transfer reinforcement has a shear force transfer connection to the first web, and a third portion of the shear transfer reinforcement has a shear transfer connection to the second web.

In another feature of that aspect of the invention, the shear transfer reinforcement is a web mounted cross-wise within the beam. In another feature, the web is mounted diametrically under the center plate bowl. In a further feature, the web has an accommodation formed therein for receiving a centerplate pin. In another feature, the truck bolster has a reinforcement running lengthwise under the centerplate bowl, the truck bolster has a reinforcement running lengthwise under the centerplate bowl, and the lengthwise running reinforcement intersects the cross-wise web. In a further feature, the reinforcement running lengthwise is a rib protruding downwardly from the centerplate bowl and furthermore the rib flares laterally.

In another feature, the shear transfer reinforcement is an archway and in another feature, the archway has an apex near to the centerplate bowl, and the second and third portions of the reinforcement are legs of the archway extending away therefrom. In an additional feature, the archway inclines at an angle from vertical. In a different feature, the truck bolster is free of longitudinally running, upwardly standing webs underneath the archway.

In a further feature, the internal shear transfer reinforcement is a first internal shear transfer reinforcement. The first internal shear transfer reinforcement is a cross-wise web standing in a vertical plane at a mid span plane of symmetry of the centerplate bowl and the truck bolster includes a second internal shear transfer reinforcement. The second internal shear transfer reinforcement is a cross-wise archway spaced outboard from the first internal shear transfer reinforcement and the cross-wise archway has a first leg rooted in the first web portion, a second leg rooted in the second leg portion, and an upper portion running under the upper flange portion between the leg portions. In another feature, a depending centerplate reinforcement rib runs length-wise from the upper portion of the archway to an upper region of the cross-wise web.

In another feature, the truck bolster has first and second brake rod apertures formed in the first and second web portions respectively, and the first and second brake rod apertures each have an area of more than 40 sq. in. In a further feature, the first brake rod aperture has an area, A, that is at least 50% greater than the largest corresponding brake rod opening defined in AAR standard S-392, as that standard read on Jan. 1, 2005, and identified as "conventional brake rod opening". In an additional feature, the first brake rod aperture has a perimeter, P, that encompasses the location of both (a) a "conventional brake rod opening"; and (b) a "WABCOPAC" brake rod opening, as those brake rod openings were defined in AAR Standard S-392, as that standard read on Jan. 1, 2005. In another feature, the area A of the brake rod opening exceeds by more than 80% the area of the largest brake rod opening defined in AAR standard S-392 as that standard read on Jan. 1, 2005. In a further feature, the brake rod aperture of the truck bolster has a perimeter, and the perimeter is free of any radius of curvature of less than 2½ inches. In an extra feature, the brake rod opening has a plurality of radiused corners, at least one of the corners having a different radius than another. In an additional feature, the brake rod opening has a radiused corner having a radius of more than 5 inches.

In another feature, the brake rod opening has a radiused corner having a radius more than 50% greater than any radius shown for a brake rod opening in AAR standard S-392, as that standard read on Jan. 1, 2005. In an additional feature, the brake rod opening of the truck bolster has a perimeter; AAR standard S-392 as it read on Jan. 1, 2005 defines a corresponding "conventional brake rod opening", AAR standard S-392 as it read on Jan. 1, 2005 defines a corresponding "WABCOPAC" brake rod opening, and the perimeter of the brake rod opening of the truck bolster encompasses both the "conventional brake rod opening" and the "WABCOPAC" brake rod opening. In a further feature, the brake rod opening of the truck bolster has a perimeter, P, and a first characteristic dimension Dh, Dh being calculated according to the formula Dh=4 A/P, and Dh is greater than 6½ inches. In another feature, Dh is greater than 8 inches.

In another feature, the first brake rod aperture of the truck bolster has a perimeter, P, an area A, and a first characteristic dimension Dh, Dh being calculated according to the formula Dh=4 A/P. The first brake rod aperture has a second characteristic dimension, Dp, Dp being calculated according to the formula Dp=(P/π) and a ratio of Dh/Dp lies in the range of 0.9 to 1.0. In a further feature, the truck bolster has a ratio of Dh/Dp greater than 0.94.

In a different feature, the first brake rod aperture of the truck bolster has a perimeter, P, an area A, and a first characteristic dimension Dh, Dh being calculated according to the formula Dh=4 A/P. The first brake rod aperture has a second characteristic dimension, Dc, Dc being calculated according to the formula Dc=the square root of [4 A/π], and a ratio of Dh/Dc lies in the range of 0.95 to 1.0. In a further feature, the upper flange portion has an upper surface, the truck bolster has side bearing seats defined on the upper surface, and the truck bolster has side bearing fitting access sockets formed therein abreast of the side bearing seats. In another feature, the upper flange portion has an upper surface, the truck bolster has side bearing seats defined on the upper surface, and the web portions of the truck bolster have deviations therein abreast of the side bearing seats, the deviations defining side bearing fitting access sockets.

In a further feature, the truck bolster has brake rod apertures in the first and second web portions, the brake rod apertures being located generally beneath the centerplate bowl and the first and second web portions are free of tool access openings outboard of the brake rod apertures.

In another aspect of the invention, there is a truck bolster of a railroad freight car truck, the truck bolster being a casting. The truck bolster has a hollow beam having first and second ends for mounting to sideframes. The truck bolster has a lengthwise direction running between the first and second ends. The hollow beam has an upper flange portion, a lower flange portion, a first web portion and a second web portion, the upper and lower flange portions and the first and second web portions being outside walls of the beam that co-operate to define a box section. There is a centerplate bowl located at mid-span between the first and second ends and an internal shear web mounted cross-wise relative to the lengthwise direction. The internal shear web is mounted to reinforce the centerplate bowl. The cross-wise web extends from the center plate bowl to the lower flange portion, and from the first web to the second web.

In another feature, the internal shear web extends diametrically beneath the centerplate bowl. In a different feature, the internal shear web has an accommodation formed therein to accommodate a centerplate pin. In another feature, the internal shear web has feet merging into the lower flange portion, and a relief defined adjacent to the lower flange portion between the feet. In another feature, the bolster has a longitudinally running centerplate reinforcement rib, and the rib intersects the internal shear web.

In a further aspect of the invention, there is a truck bolster for a railroad freight car truck. The truck bolster includes a beam having a first end for mounting to a first sideframe, a second end for mounting to a second sideframe, and a centerplate bowl at mid-span between the first and second ends. The truck bolster has side bearing seats defined thereon, and attachment fittings for the side bearing seats. The truck bolster has side bearing fitting access sockets formed in the beam abreast of the side bearing seats.

In another feature of that aspect of the invention, the beam has an upper flange and webs extending lengthwise therealong and downwardly therefrom. The sidebearing seats are defined on the upper flange, and the sockets are formed in the webs. In an additional feature, a wall of one of the sockets is formed by a deviation formed in one of the webs. In another feature, the beam includes a top flange and a pair of spaced apart webs running along, and extending downwardly therefrom, the attachment fittings include two spaced apart bores formed through the top flange, the bores having centerlines, and at least a portion of one of the webs passes between the centerlines of the bores.

In another aspect of the invention, there is a railroad freight car truck bolster. The truck bolster is a casting. The truck bolster includes a hollow beam having a first and a second end for mounting in a rail road car truck sideframe, and a centerplate bowl mounted in a mid-span position between the first and second ends. Brake rod apertures are formed in the beam, the brake rod apertures being located generally beneath the centerplate bowl. The hollow beam has an upper flange, a lower flange, and predominantly upwardly standing first and second webs extending between the upper and lower flanges. The first and second webs being free of hand access openings outboard of the brake rod apertures. In a feature of that aspect of the invention, side bearing seats are defined on the upper flange of the truck bolster, side bearing fitting access sockets are defined in the webs abreast of the side bearing seats, and the webs are substantially planar between the brake rod apertures and the sockets.

In yet another aspect of the invention there is a truck bolster for a railroad freight car truck, the truck bolster having a brake rod opening defined therein. The brake rod opening has an area, A, of greater than 40 sq. in. In another feature of that aspect of the invention, the brake rod opening area is greater than 50 sq. in. In another feature, the area A exceeds by at least 80% the area of the largest corresponding brake rod opening defined in AAR standard S-392 as that standard read on Jan. 1, 2005.

In a further feature, the brake rod opening of the truck bolster has a perimeter, and the perimeter is free of any radius of curvature of less than 2½ inches. In another feature, the brake rod opening has a plurality of radiused corners, at least one of the corners having a different radius than another. In a further feature, the brake rod opening has a radiused corner having a radius of more than 5 inches. In another feature, the brake rod opening has a radiused corner having a radius more than 50% greater than any radius shown for a brake rod opening in AAR standard S-392 as it read on Jan. 1, 2005. In a further feature, the brake rod opening of the truck bolster has a perimeter, AAR standard S-392, as it read on Jan. 1, 2005 defines a corresponding "conventional brake rod opening", AAR standard S-392, as it read on Jan. 1, 2005 defines a corresponding "WABCOPAC" brake rod opening, and the perimeter of the brake rod opening of the truck bolster encompasses both the "conventional brake rod opening" and the "WABCOPAC" brake rod opening.

In another feature, the brake rod opening of the truck bolster has a perimeter, P, and a first characteristic dimension Dh, Dh is calculated according to the formula Dh=4 A/P, and Dh is greater than 6½ inches. In a further feature, Dh is greater than 7½ inches. In an additional feature, the brake rod opening of the truck bolster has a perimeter, P, and a first characteristic dimension Dh, Dh being calculated according to the formula Dh=4 A/P. The brake rod opening has a second characteristic dimension, Dp, Dp being calculated according to the formula Dp=(P/π) and a ratio of Dh/Dp lies in the range of 0.9 to 1.0. In a further feature the ratio Dh/Dp is greater than 0.94. In another feature, the brake rod opening of the truck bolster has a perimeter, P, and a first characteristic dimension Dh, Dh being calculated according to the formula Dh=4 A/P. The brake rod opening has a second characteristic dimension, Dc, Dc being calculated according to the formula Dc=the square root of [4 A/π] and a ratio of Dh/Dc lies in the range of 0.95 to 1.0.

In another aspect of the invention there is a truck bolster. The bolster is a casting and has a rating of at least "100 Tons". The bolster has a top flange, a bottom flange, and webs extending between the top and bottom flanges. The flanges and the webs co-operate to define a hollow beam. The beam has a deep central portion and shallower end portions. The bottom flange includes first and second portions ascending outboard from the deep central portion to the end portions. The first ascending portion lies in a plane. The first ascending portion merges into a first of the end portions at a first transition. The first transition is free of any deviation extending inboard and upward of the plane.

In a further aspect of the invention, there is a truck bolster. The bolster is a casting and has a rating of at least "100 Tons". The bolster has a top flange, a bottom flange, and webs extending between the top and bottom flanges. The flanges and the webs co-operate to define a hollow beam. The beam has a deep central portion and shallower end portions. The bottom flange includes first and second portions ascending outboard from the deep central portion to the end portions. The bottom flange has a first transition from the deep central portion to the ascending portion and a second transition from the ascending portion to the end portion, respectively. The first transition has a first radius of curvature, $R_1$. The second transition has a second radius of curvature, $R_2$ and $R_2$ is at least one half of $R_1$.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
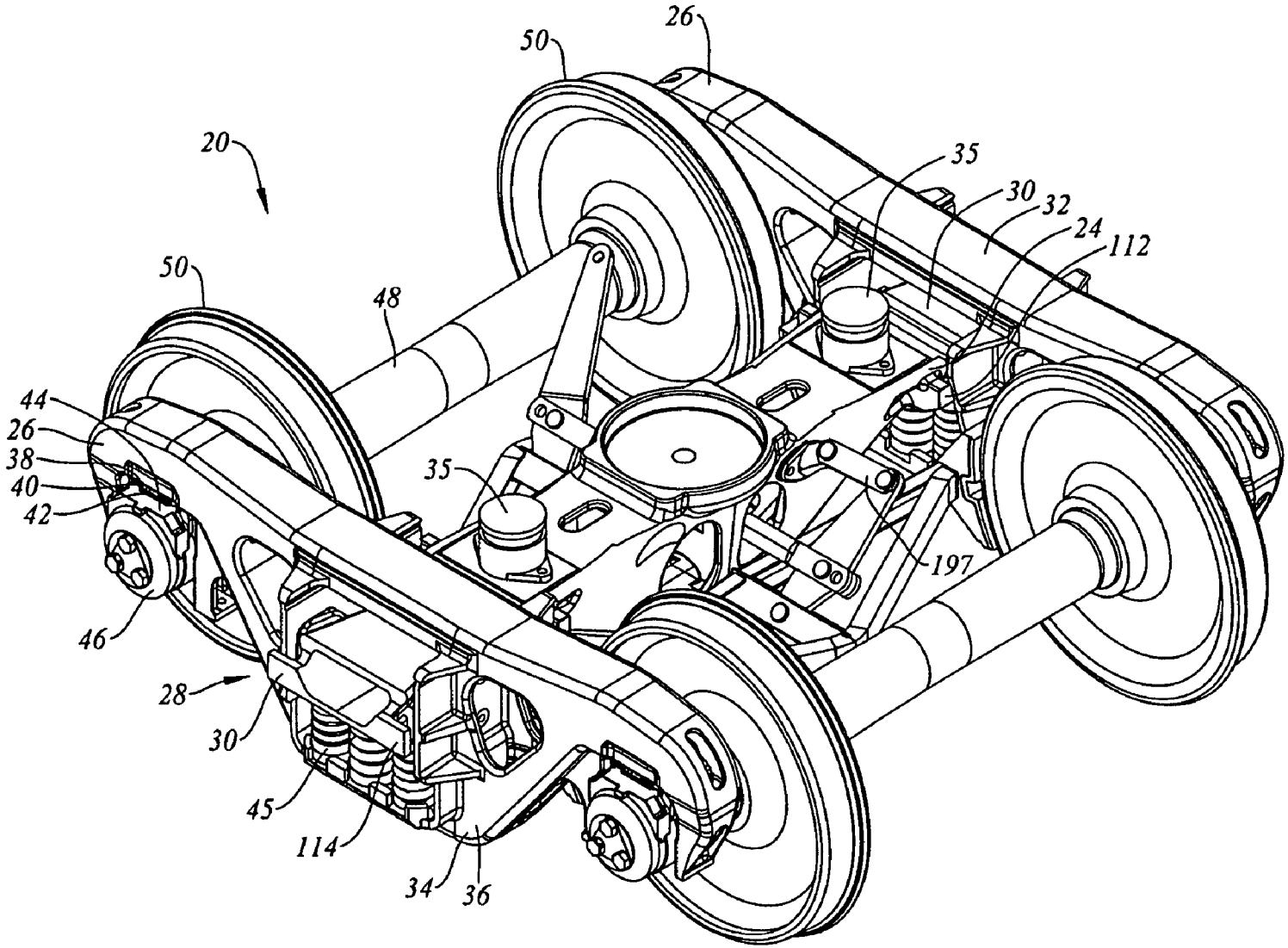
FIG. 1*a* is an isometric, general arrangement view of a railroad car truck such as may incorporate a truck bolster.
Figure 1B:
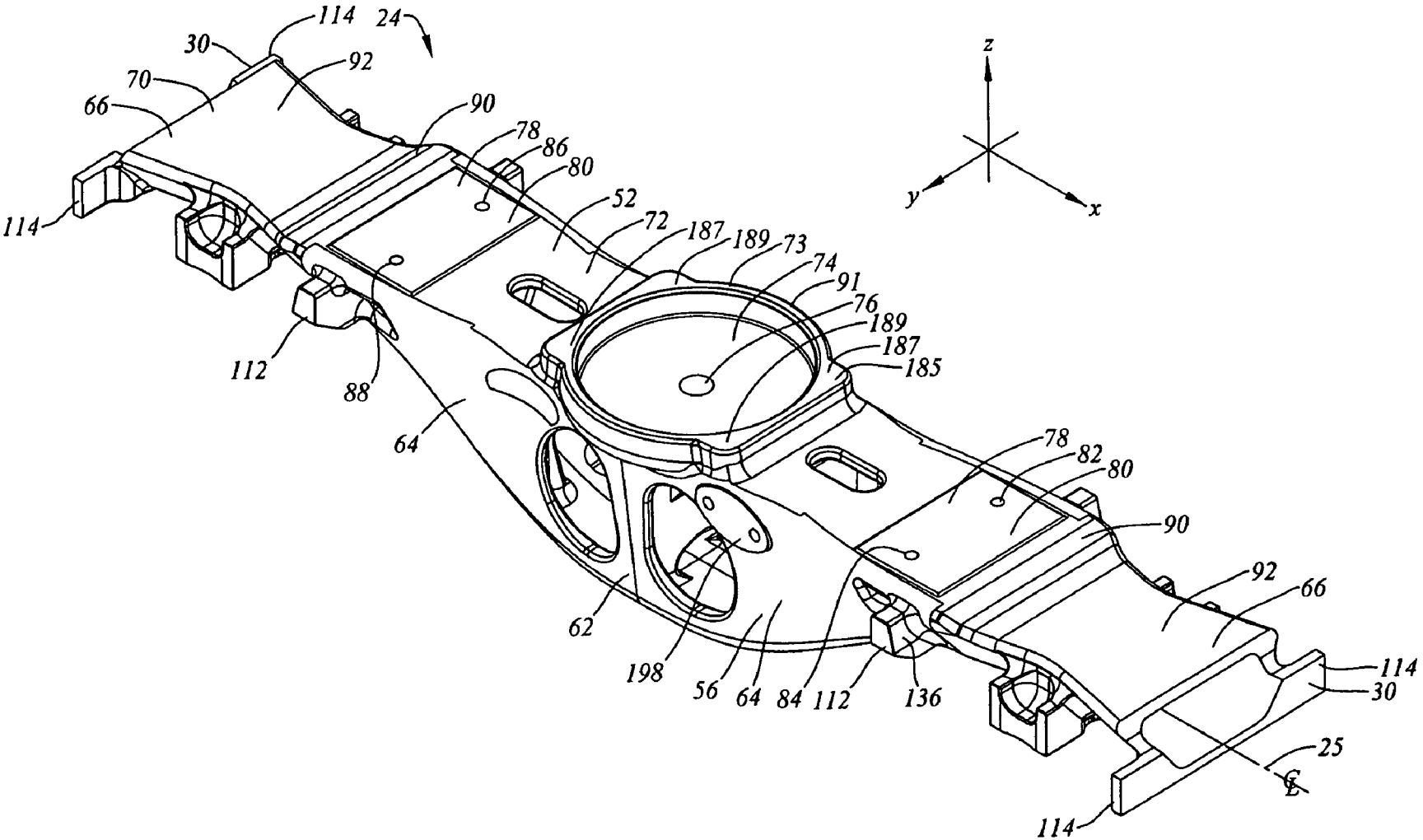
FIG. 1*b* is a perspective view of the truck bolster of FIG. 1*a*, from above and to one side.
Figure 1C:
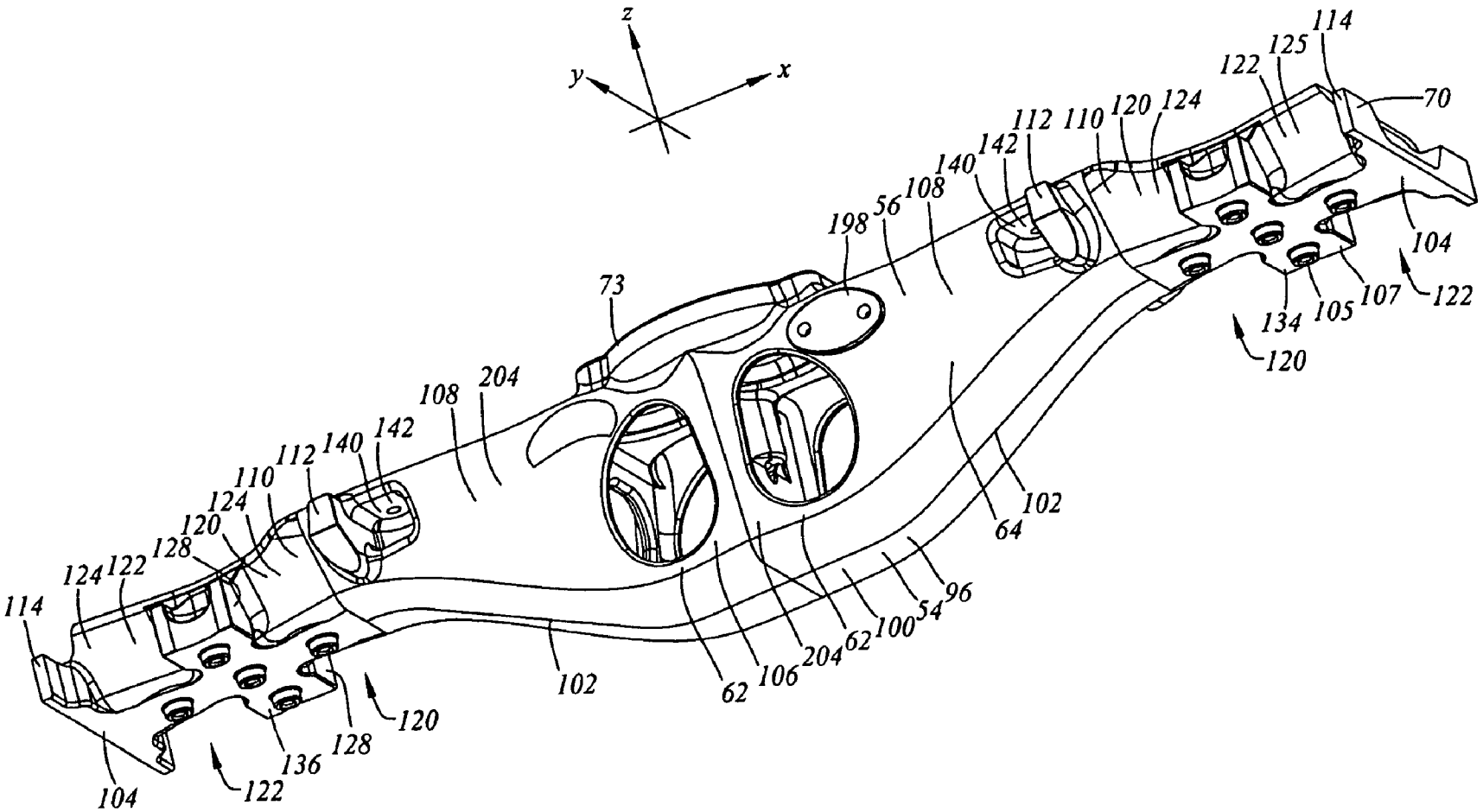
FIG. 1*c* is a further perspective view of the truck bolster of FIG. 1*a*, from below and to one side.

The description that follows, and the embodiments described therein, are provided by way of illustration of an example, or examples, of particular embodiments of the principles and aspects of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the rail road car truck described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. In the context of the truck as a whole, the term lateral, or laterally outboard, refers to a distance or orientation relative to the longitudinal centerline of the railroad car, or car unit, or of the centerline of the centerplate bowl of the truck. The term "longitudinally inboard", or "longitudinally outboard" is a distance taken relative to a mid-span lateral section of the truck. Pitching motion is angular motion of a railcar unit about a horizontal axis perpendicular to the longitudinal direction. Yawing is angular motion about a vertical axis. Roll is angular motion about the longitudinal axis.

In the context of the truck bolster, such as bolster 24, described below, when the car is stationary on straight, level track, the long, or longitudinal axis 25 of the truck bolster tends to be oriented cross-wise to the longitudinal axis of the truck or of the railroad car more generally. In this description, the lengthwise axis of the bolster may be considered the x-axis. The transverse direction of the bolster may be considered the direction of the fore-and-aft thickness of the bolster, relative to the rolling direction of the truck, and may be designated the y-axis. The up and down direction, which may be parallel to the axis of the axis of the centerplate pin, when installed, may be considered the vertical or z-direction.

Reference may be made herein to various plate sizes or standards of the Association of American Railroads, the AAR. Unless otherwise specified, those standards are to be interpreted as they were at the date of filing of this application, or if priority is claimed, then as of the earliest date of priority of any application in which the standard is identified, those standards being understood to read the same as they did on Jan. 1, 2005.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GRL) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GRL and the "70 Ton Special" low profile truck sometimes used for auto rack cars. Given that the rail road car truck described herein may tend to have both longitudinal and transverse axes of symmetry, a description of one half of an assembly may generally also be intended to describe the other half as well, allowing for differences between right hand and left hand parts.

This description refers, in part, to friction dampers, and damper seats for rail road car trucks, and to multiple friction damper systems. There are several types of damper arrangements, some being shown at pp. 715-716 of the 1997 *Car and Locomotive Cyclopedia*, those pages being incorporated herein by reference. Each of the arrangements of dampers shown at pp. 715 to 716 of the 1997 *Car and Locomotive Cyclopedia* can be modified to employ a four cornered, double damper arrangement of inner and outer dampers. In terms of general nomenclature, damper wedges tend to be mounted within an angled "bolster pocket" formed in an end of the truck bolster. In cross-section, each wedge may then have a generally triangular shape, one side of the triangle being, or having, a bearing face, a second side which might be termed the bottom, or base, forming a spring seat, and the third side being a sloped side or hypotenuse between the other two sides. The first side may tend to have a substantially planar bearing face for vertical sliding engagement against an opposed bearing face of one of the sideframe columns. The second face may not be a face, as such, but rather may have the form of a socket for receiving the upper end of one of the springs of a spring group. Although the third face, or hypotenuse, may appear to be generally planar, in some embodiments it may tend to have a slight crown, having a radius of curvature of perhaps 60". The crown may extend along the slope and may also extend across the slope. The end faces of the wedges may be generally flat, and may have a coating, surface treatment, shim, or low friction pad to give a smooth sliding engagement with the sides of the bolster pocket, or with the adjacent side of another independently slidable damper wedge, as may be.

During railcar operation, the sideframe may tend to rotate, or pivot, through a small range of angular deflection about the end of the truck bolster to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the sideframe column. Although, in some embodiments the slope face may have a slight crown, for the purposes of this description it will be described as the slope face or as the hypotenuse, and will be considered to be a substantially flat face as a general approximation.

In the terminology herein, wedges may have a primary angle $\alpha$, being the included angle between (a) the sloped damper pocket face mounted to the truck bolster, and (b) the side frame column face, as seen looking from the end of the bolster toward the truck center. In some embodiments, a secondary angle $\beta$ may be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper parallel to the plane of angle $\alpha$. As the suspension works in response to track perturbations, the wedge forces acting on the secondary angle $\beta$ may tend to urge the damper either inboard or outboard according to the angle chosen.

FIG. 1*a* shows an example of a rail road car truck 20 that is intended to be generically representative of a wide range of trucks in which the present invention may be employed. While truck 20 may be suitable for general purpose use, it may be optimized for carrying relatively low density, high value lading, such as automobiles or consumer products, for example, or for carrying denser semi-finished industrial goods, such as might be carried in rail road freight cars for transporting rolls of paper, or for carrying dense commodity materials be they coal, metallic ores, grain, potash, steel coils or other lading. Truck 20 is generally symmetrical about both its longitudinal and transverse, or lateral, centreline axes. Where reference is made to a sideframe, it will be understood that the truck has first and second sideframes, first and second spring groups, and so on.

Truck 20 has a truck bolster 24 and first and second side frames 26. Side frames 26 may be metal castings, and may preferably be steel castings. Each side frame 26 has a generally rectangular side frame window 28 that accommodates one of the ends 30 of the bolster 24. The upper boundary of window 28 is defined by the side frame arch, or compression member identified as top chord member 32, and the bottom of window 28 is defined by a tension member identified as bottom chord 34. The fore and aft vertical sides of window 28 are defined by a pair of first and second side frame columns 36. The ends of the tension member sweep up to meet the compression member. At each of the swept-up ends of side frame 26 there are side frame pedestal fittings, or pedestal seats 38. Each fitting 38 accommodates an upper fitting, which may be a rocker or a seat. This upper fitting, whichever it may be, is indicated generically as 40. Fitting 40 engages a mating fitting 42 of the upper surface of a bearing adapter 44. Bearing adapter 44 engages a bearing 46 mounted on one of the ends of one of the axles 48 of the truck adjacent one of the wheels 50 of one of the wheelsets. A fitting 40 is located in each of the fore and aft pedestal fittings 38, the fittings 40 being longitudinally aligned.

In operation, bolster 24 is able to pivot about the vertical or z-axis with respect to the body of the railroad car, or car unit, more generally, while the vertical load of the railroad car is carried into the bolster through the center plate bowl 74 and the side bearings 35. Bolster 24 can move up and down in the side frame windows 28 on the spring groups 45 in response to vertical perturbations. The vertical motion may tend to carry along friction dampers 47, 49 seated in the bolster pockets 120, 122 of bolster 24, causing friction dampers 47, 49 to ride against the side frame columns 36, and thereby to damp out the motion. Dampers 47, 49 may be arranged in first and second damper groups, mounted respectively at the first and second ends of bolster 24. Each damper group may include 4 dampers. Each of those dampers may be sprung independently of any other, and may be arranged in a four cornered arrangement, namely with two dampers facing each sideframe, one being outboard of the other. Bolster 24 may be displaced laterally relative to the side frames in response to lateral perturbations, subject to the range of travel permitted by the bolster gibs 112, 114. The spring groups 45 and the sideways swinging, or rocking motion of the side frames may tend to resist this lateral motion and may tend to restore bolster 24 to an equilibrium position with the amplitude of the lateral rocking or swinging motion decreasing as the dampers work against the side frame column wear plates. When side-to-side leaning or rocking motion of the car body occurs, loads may be carried into the truck bolster at the side bearings 35 mounted to the upper surface of bolster 24 from the engaging side bearing surfaces of the body bolster of the rail road car body.

Bolster 24 may be thought of as having three types of regions: (1) the deepest portion lying generally underneath the center plate bowl; (2) relatively shallow end portions or regions that locate in the sideframe windows; and (3) intermediate transition regions, or arms, that extends between the first and second regions. These regions are identified as center or mid-span region 62, intermediate or transition arm region 64, and outboard, or end region 66.

Bolster 24 may have a long axis, 25. Bolster 24 may have a plane of symmetry that runs lengthwise (i.e., along axis 25) and vertically. Aside from such features as brake fittings, bolster 24 may also have a mid-span vertical plane of symmetry that is perpendicular to long axis 25. Mid-span centerline 27 lies in this vertical plane to which axis 25 is normal. Bolster 24 may include an upper portion, 52, a lower portion 54, a first sidewall portion 56 and a second sidewall portion 58. These portions may be joined in a generally box-like configuration, in section, to form a beam in which upper portion 52 may tend to function as a first flange, lower portion 54 may tend to function as a second flange, and first and second sidewall portions 56 and 58 may tend to be, or to function as, shear transfer members, or shear transfer webs, linking the upper and lower portions 52 and 54. That is to say, the portions 52, 54, 56, and 58 co-operate to define a beam having webs and flanges, which beam may have a hollow interior, indicated generally as 60, which may include one or more cavities or sub-cavities. This beam may tend to have a greater through thickness depth between the upper and lower flanges in its mid-span region 62 than at its shallower end regions 66. These portions may be integrally formed portions of a single monolithic casting, 70, which may be fabricated of a material such as a steel alloy. In operation, the upper flange may tend to be a compression member, and the lower flange may tend to be a tension member.

Upper portion 52 may include a wall member, which may be identified as an upper flange 72. At the mid span location, upper flange 72 may have an upstanding generally circular lip or rim 73 that defines the outer peripheral wall of a center plate bowl 74, such as may accommodate a mating center plate of a railroad car body. At the center of the center plate bowl, there may be a concentrically located accommodation for a center plate pin, that accommodation being indicated generally as 76. At some distance radially away from accommodation 76, laterally outboard beyond the rim of bowl 74, there may be a side bearing mount, or seat, 78. Seat 78 may be a raised portion of upper flange 72. That is, it may stand proud of the surrounding region, and, where bolster 24 is a casting, after casting, seat 78 may be milled to give a machined flat, or other configuration to yield an interface 80 to which a side bearing, such as side bearing 35 may be mounted. Flange 72 may include mounting fittings 82, 84 such as may permit mechanical attachment of side bearing 35 to seat 78. For example, fittings 82, 84 may include bores 86, 88, and the mechanical attachment may be by way of bolts or other threaded fasteners. In one embodiment, the side bearing seat may be a generally rectangular flat patch, centered roughly 25 inches outboard of the mid span truck centerline. Flange 72 may have a downwardly sloped transition 90 lying outboard of seat 78, and a more distant distal region 92 such as may pass through the sideframe window.

Lower portion 54 may include a lower flange member 96, such as may have a mid-span portion 100 lying generally beneath center plate bowl 74; upwardly and outwardly inclined sloped regions 102 lying outboard thereof; and distal regions 104 extending from the inclined regions 102 to the end of bolster 24. The through thickness of lower flange member 96 may tend to be greatest in mid-span portion 100, and may be tapered in a general reduction in thickness in inclined regions 102, to a once again thicker portion in distal end regions 104. The underside of distal region 104 may include fittings in the nature of spring coil end retainers 105 defining the upper spring seat 107 for receiving the upper ends of the spring coils of the spring group, and for receiving the upper ends of the friction dampers.

Each of first and second side wall portions 56, 58 may include a deep central region 106, which may extend between, and form a shear web connection between, (a) the mid span region of upper flange 72 under center plate bowl 74 and (b) mid-span portion 100 of lower flange member 96. Sidewall portions 56, 58 may further include a transition or intermediate portion 108, and an end portion 110. Transition portion 108 may narrow in depth (i.e., become more shallow) from the inboard portion to the outboard portion, and again, may form the shear web connection between the upper and lower flanges in transition region 102.

Figure 2A:
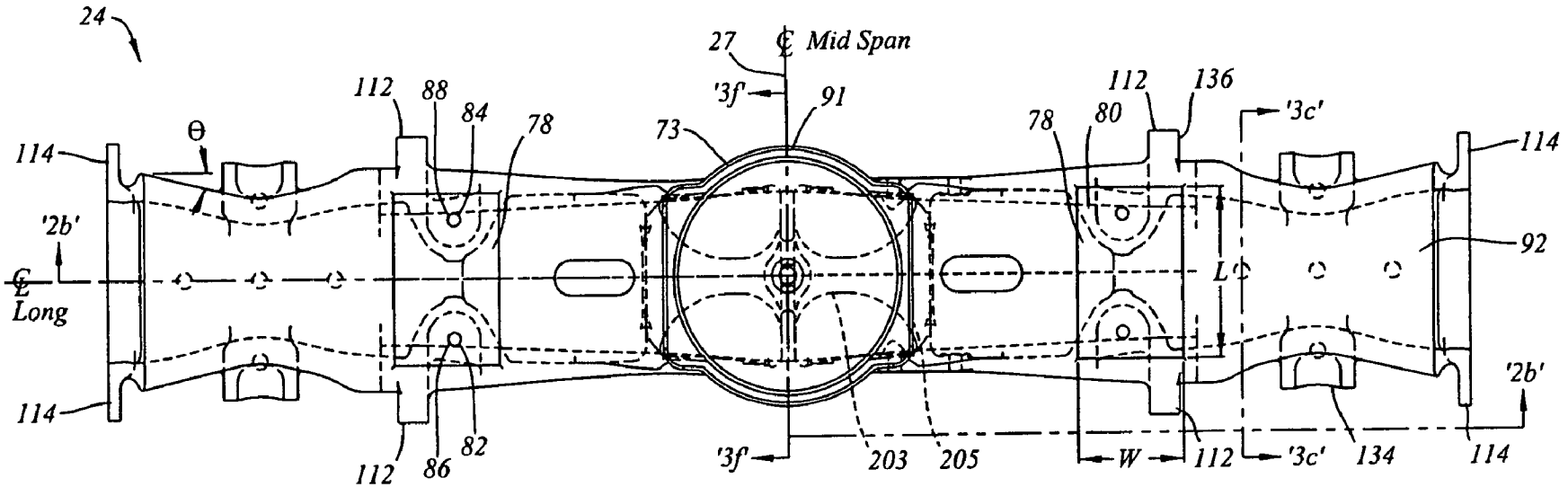
FIG. 2*a* is a top view of the truck bolster of FIG. 1*a;*
Figure 2B:
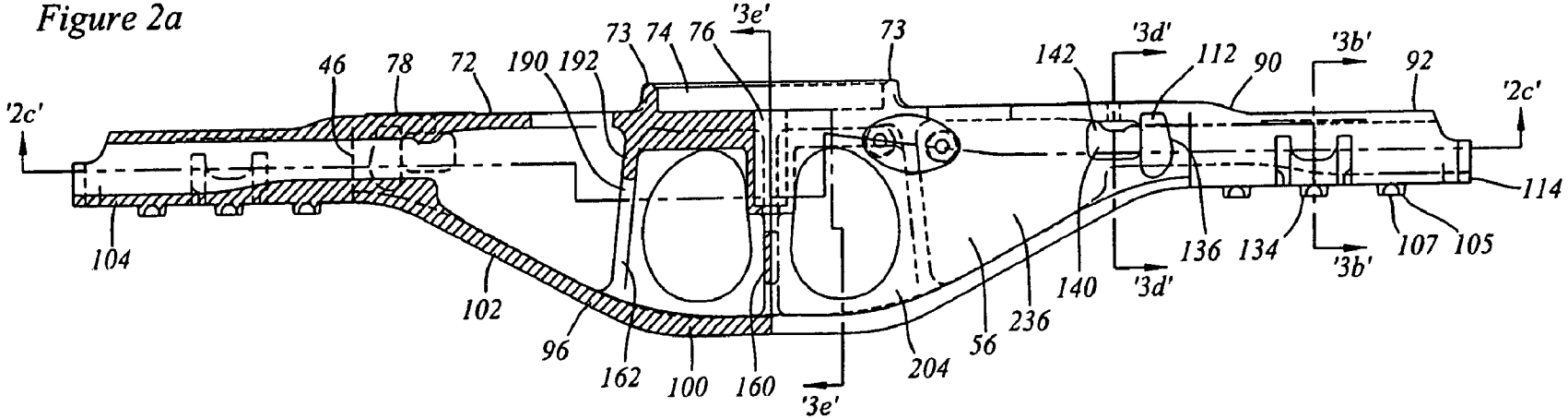
FIG. 2*b* shows a side, or elevation, view of the bolster of the truck of FIG. 1*a*, one half of that view being a sectional view taken along the longitudinal centerline of the truck bolster as indicated by section '2*b*-2*b*' in FIG. 2*a;*
Figure 2C:
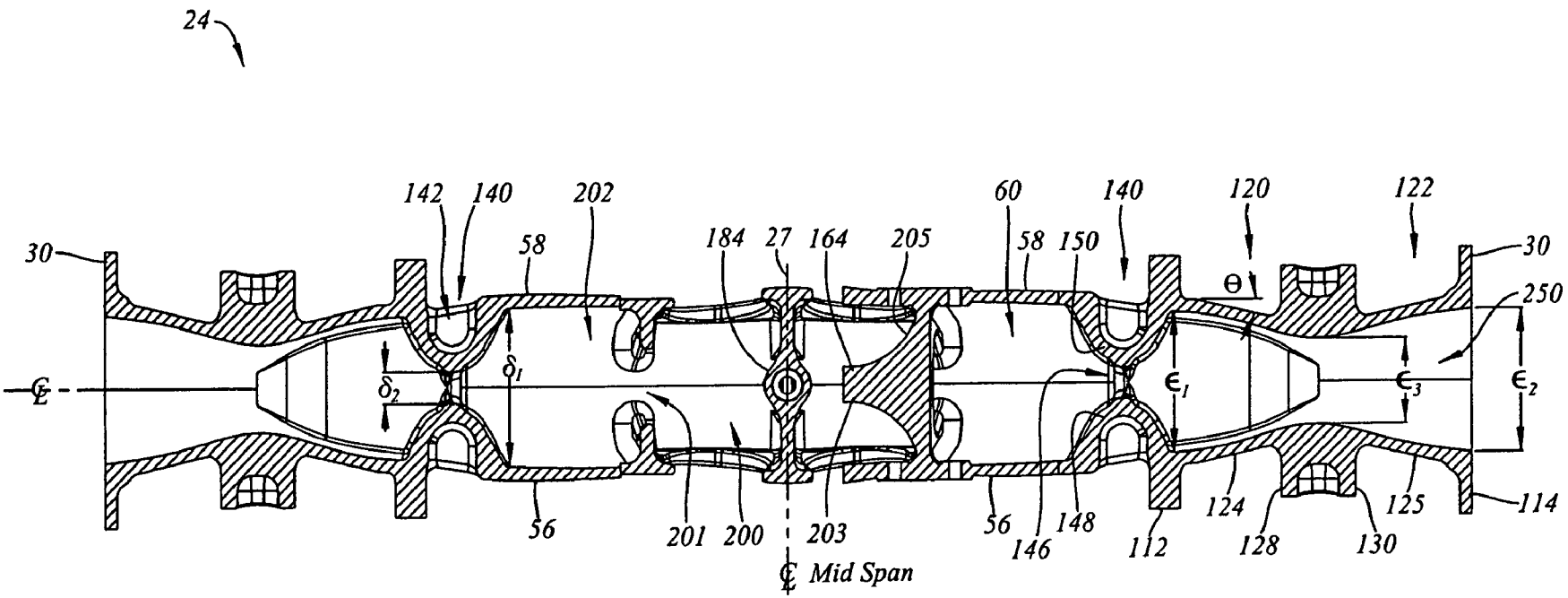
FIG. 2*c* is a half cross-sectional view, in elevation, on '2*c*-2*c*' of the bolster of FIG. 2*b;*
Figure 2D:
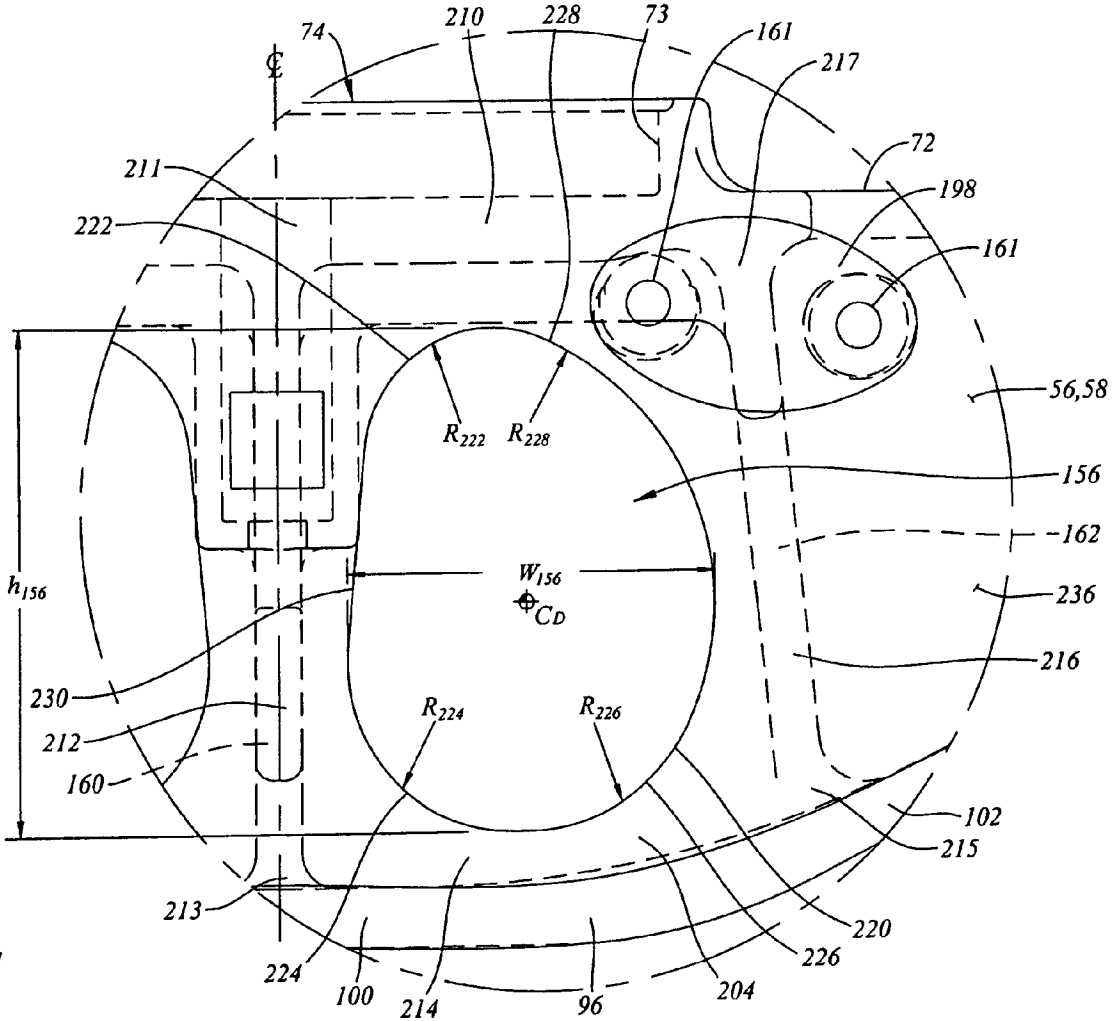
FIG. 2*d* is an enlarged detail of a lightening aperture of the truck bolster of FIG. 2*a;*
Figure 2E:
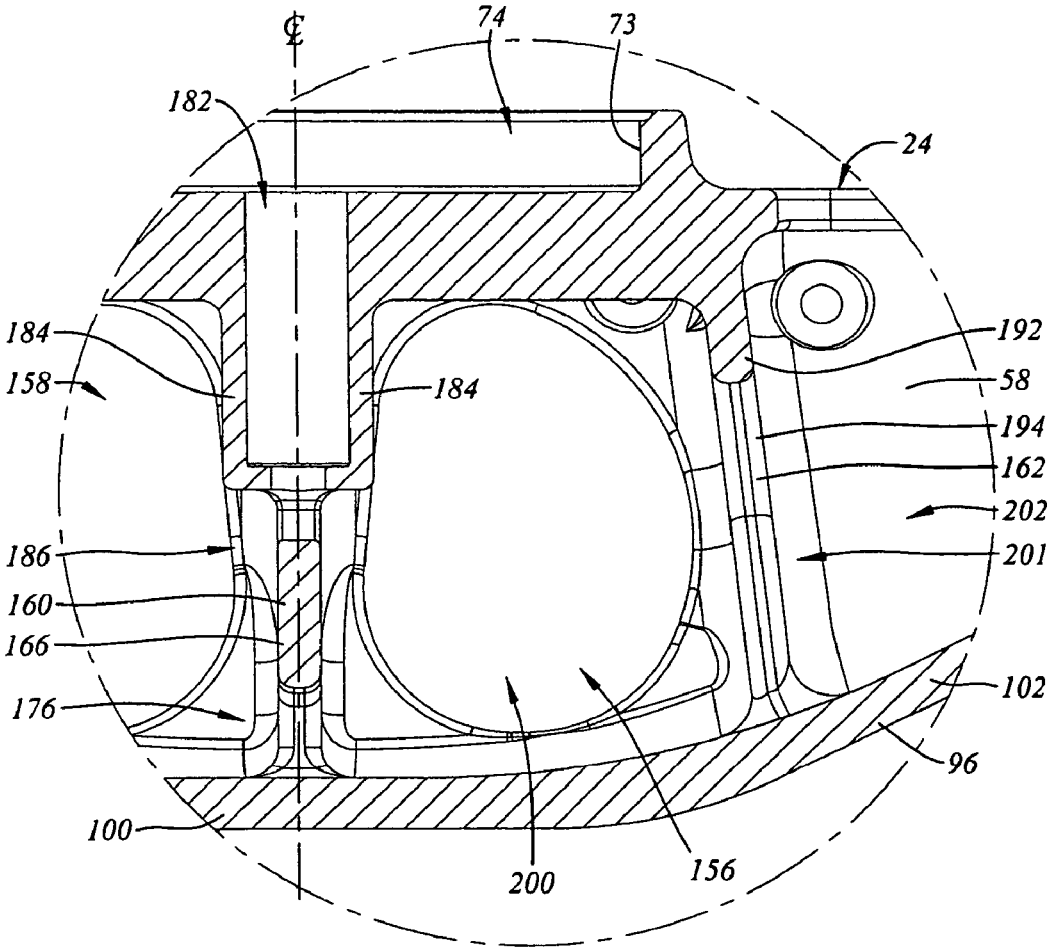
FIG. 2*e* is an enlarged cross-sectional detail taken on the longitudinal centerline of the truck bolster of FIG. 2*d*, from the same viewpoint as that of FIG. 2*d;*
Figure 2F:
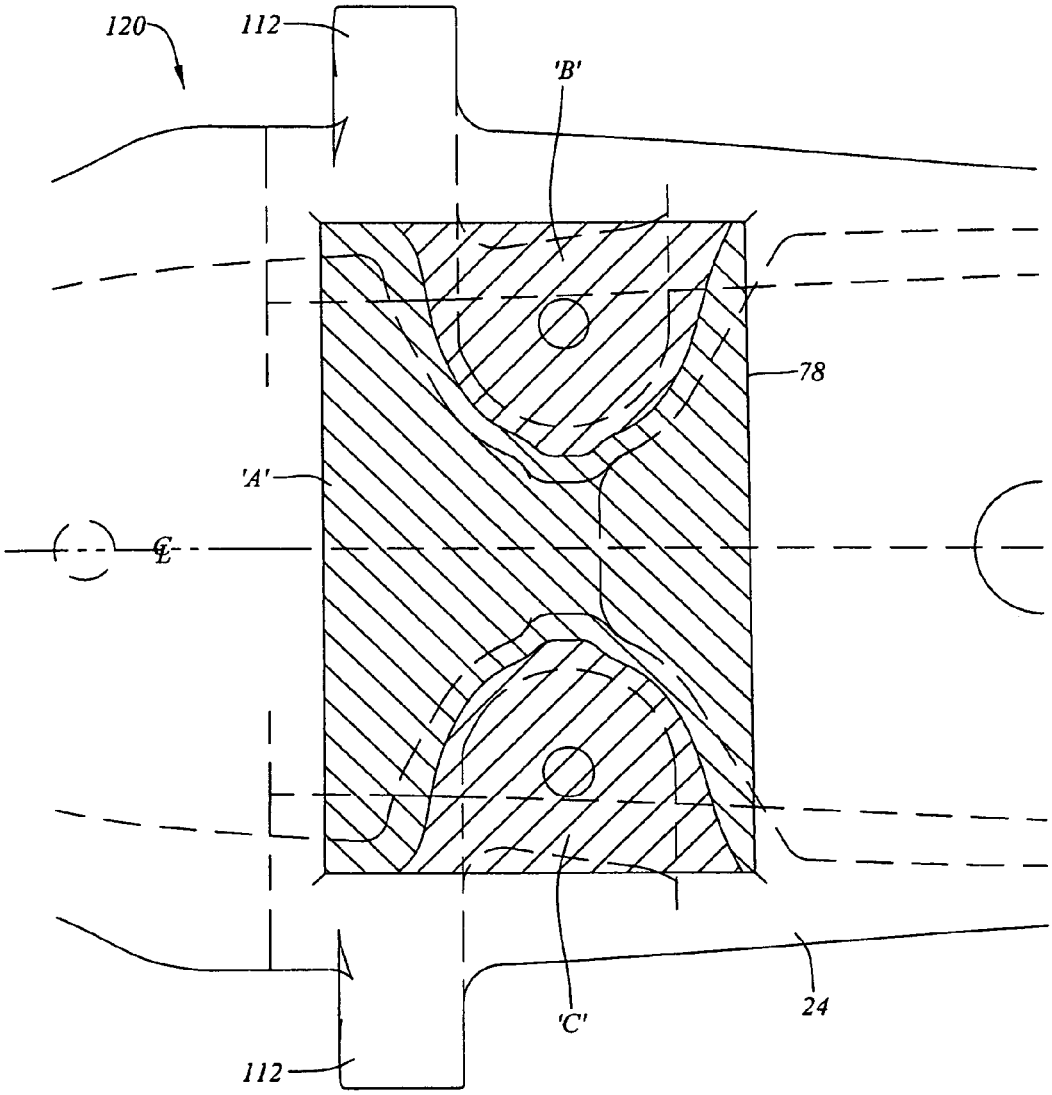
FIG. 2*f* is an enlarged detail, from above, of a side bearing seat region of the bolster of FIG. 2*a*.

Sidewall portions 56, 58 may include inboard gibs 112 and outboard gibs 114. Either or both of those gibs may be tapered as described in my copending U.S. patent application Ser. No. 11/002,222 filed Dec. 3, 2004, and which is incorporated herein by reference. Each end of bolster 24 may further include inboard and outboard bolster pockets, 120, 122. Inboard bolster pocket 120 may have a substantially planar inclined face 124 that may be inclined with respect to the vertical by a primary angle $\alpha$. Face 124 may also include a lateral bias, represented by secondary angle $\beta$. The apparent lateral rake angle, $\theta$, of the bolster pocket due to secondary angle $\beta$ may be seen in the downwardly looking sectional view of FIG. 2*c*, but a true view of secondary angle $\beta$ may be seen by sighting along the inclined plane of angle $\alpha$. Bolster pocket 120 may include an outboard lateral wall 128 extending perpendicular to long axis 25. Wall 128 co-operates with the sloped wall defined by face 124 to form a two sided notch with a face width corresponding to the width of a damper wedge, with tolerance, such that a damper wedge installed in pocket 120 may tend to be constrained to work along face 124 and along the walled guideway or trackway defined by wall 128, with a tendency to bear against wall 128 by virtue of the secondary rake angle, $\beta$. Similarly, outboard pocket 122 may include an inclined face 125 that may be inclined at primary angle $\alpha$ and secondary angle $\beta$, but of opposite hand, and an inboard wall 130, which may be spaced in mirror arrangement to wall 128 and face 124. Bolster 24 may include a spring land 134 between walls 128 and 130. An intermediate end row coil spring of spring group 45 may bear against the underside of land 134. Land 134 may be part of the upper spring seat 107. In contrast to conventional bolster pockets that may have 3 walls (namely a sloped face bracketed between a pair spaced apart parallel side walls), in some embodiments the bolster pocket or pockets, may have only two walls namely, the sloped face and one side face. For example, bolster pocket 120 may have only face 124 and outboard wall 128 to which axis 25 is normal. In this embodiment slope face 124 may merge on a radiused edge into the vertical web portion 56 rather than into another bolster pocket sideface. This may tend to reduce the sharpness or suddenness of the transition in width of, for example, the bottom flange in the transition region from the arm region to the end region of the bolster. This may be seen by looking at the end of the bolster from below, in which the flat central portion of the bottom flange is approximately the same width as the broader portion of the bottom flange at the inboard commencement of face 124, and then necks down to a narrower portion according to angle θ. When viewed from below, the end portion of the bottom flange may have a cruciform shape in which the cross arm is defined by the lands under the middle spring seats, and the stem is tapered to be broad at the distal ends, and narrow at the waist, the taper on the stems being that of angle θ. It may be that only the inboard stem of this cruciate form is tapered. In this embodiment, the bias of angle β may tend to urge the inboard and outboard dampers laterally toward each other.

Figure 3A:
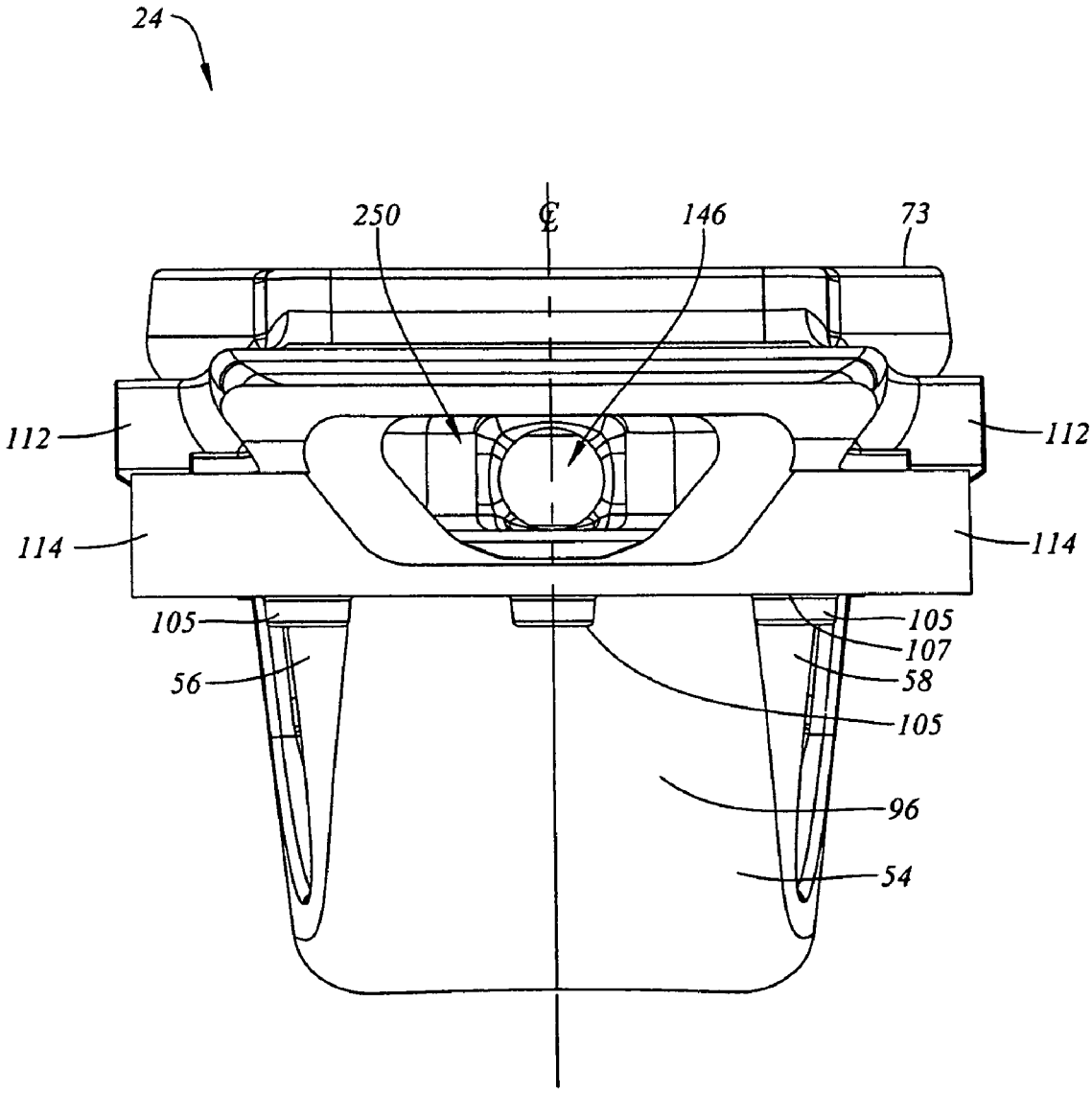
FIG. 3*a* is an end, or profile, view of the truck bolster of FIG. 2*a;*
Figure 3B:
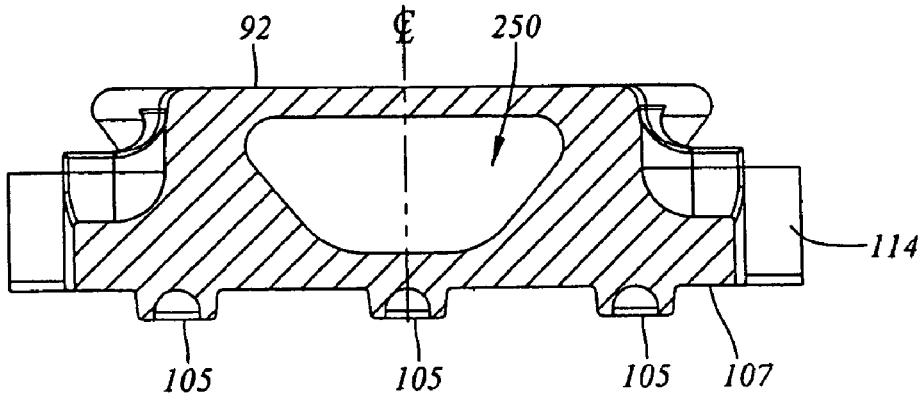
FIG. 3*b* is a cross-sectional view, in profile, on '3*b*-3*b*' of the bolster of FIG. 2*b* taken through the center row of the spring seat.
Figure 3E:
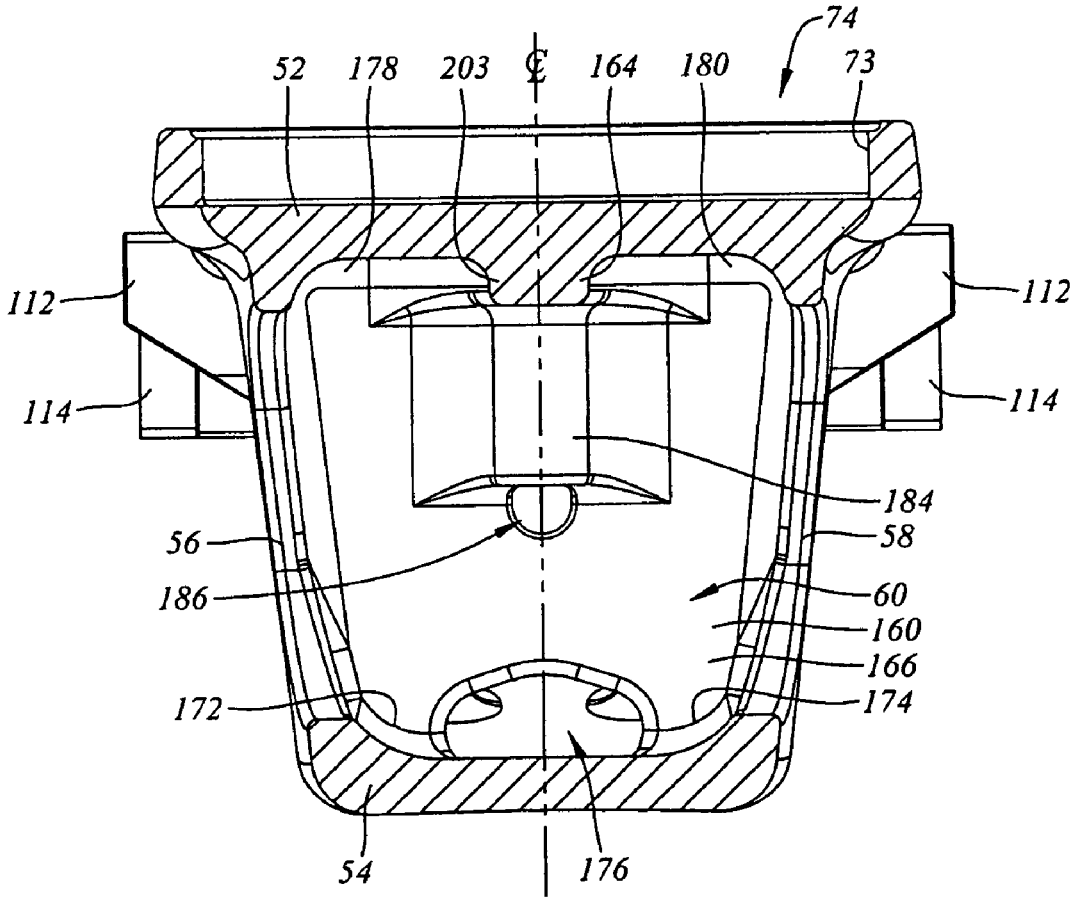
FIG. 3*e* is a cross-sectional view, in profile, on '3*e*-3*e*' of FIG. 2*b* taken on a staggered section predominantly to one side of the midspan vertical plane of the truck bolster.
Figure 3C:
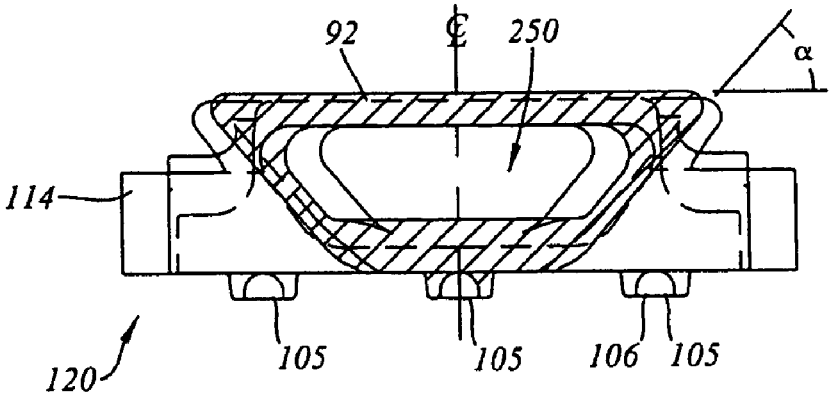
FIG. 3*c* is a cross-sectional view, in profile, on '3*c*-3*c*' of FIG. 2*b* taken through the center of the spring row inboard row of the spring seat.
Figure 3D:
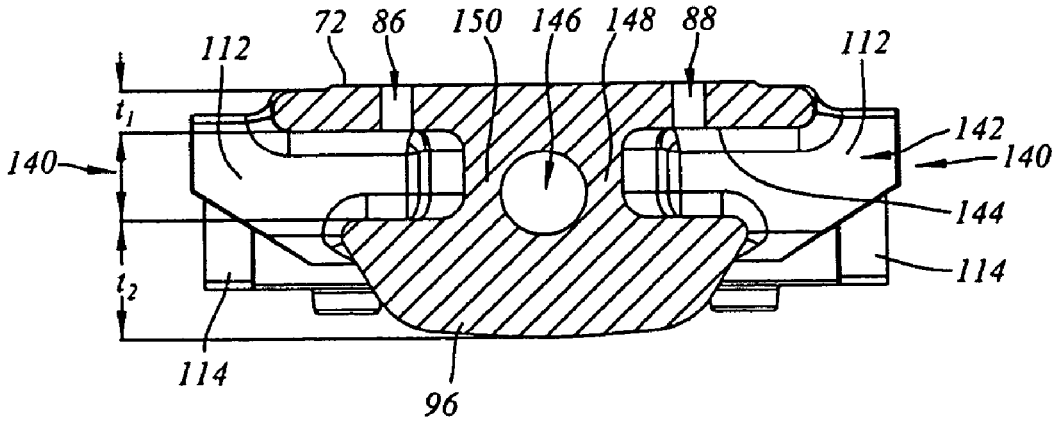
FIG. 3*d* is a cross-sectional view, in profile, on '3*d*-3*d*' of FIG. 2*b* taken through the side bearing mount.

The outboard margin of side bearing seat 78 may be located at a station of bolster 24 measured along axis 25 that corresponds roughly to the station of the abutment surface 136 of inboard bolster gib 112. Inboard of bolster pocket 120 and gib 112, bolster 24 may have reliefs 140. Relief 140 may be located generally abreast of seat 78. Each relief 140 may be in the nature of an alcove, or socket, or pocket, 142 let inwardly from the sidewall, and may be such as to permit the introduction of a tool head, such as an open end or box-head wrench, or a ratchet and socket, to provide direct access to the underside of bore 86, 88 through which the mounting hardware of the side bearing may be introduced, with a nut bearing on the underside of upper flange 72 as at the location identified as 144. At this location, top flange 72 of bolster 24 may be wider and substantially thinner than bottom flange 96, as shown by comparison of thicknesses $t_1$ and $t_2$ in FIG. 3*d*. There may be an open cavity, or passage 146 between webs 148 and 150 at this location.

In the region of relief 140, the web portions 148, 150 of web sidewall portions 56, 58 may deviate transversely inwardly under the region of side bearing seat 78 and may define the inner wall of pocket 142. This deviation may carry portions 148 and 150 inward of, and between bores 86, 88 of the mounting fittings of the side bearings. Whereas the distance between sidewall portion 56 and sidewall portion 58 immediately inboard of this location may be designated as $\delta_1$, the gap width between web portions 148 and 150, designated as a $\delta_2$ may be less than ⅔ of that width, and may be less than half of $\delta_1$. Bolster 24 may be free of any other vertical web or other reinforcement supporting seat 78 other than web portions 148, 150. That is to say, side bearing seat 78 may have a width 'W' between inboard and outboard margins 152 and 154. The arc length of web portions 148, 150, as measured at the middle of the thickness of the wall, is greater that width W, and may be in the range of 5:4 to 2:1 times as great. Expressed alternately, the gap '$\delta_1$' between web portions 148, 150, being the minimum gap width under seat 78, and along the line of centers of bores 86 and 88 may be less than half the length 'L' of seat 78, and less than half the length between the centers of bores 86 and 88. Alternatively put, if seat 78 has an area of L×W, then web portions 148 and 150 may be said to divide that area into three regions, identified as a central region 'A', lying between the webs, and lateral regions 'B' and 'C' lying transversely outboard of the arc length center lines of web portions 148 and 150. The sum of the areas of 'A', 'B' and 'C' equal 100% of L×W. Regions 'B' and 'C' may be of equal area. The ratio of the area of region 'B' to the area of region 'A' may lie in the range of 2:3 to 2:1, and in one embodiment may be about 3:4, (+/−20%). In another way of expressing this, it may be that no point in the area LW lies more than ⅖ L from the nearest underlying vertical web, and, in one embodiment, this distance may be about ⅓ of L.

In the central region of sidewall portions 56 and 58, there may be brake rod apertures 156, 158. Aperture 156 in sidewall portion 56 may be aligned with aperture 158 in sidewall portion 58, thereby making a fore-and-aft passageway through bolster 24. The profiles of these apertures 156, 158 may be formed with corner radii tending to be larger than may formerly have been used, and may tend to provide a larger passage for brake equipment, and may also tend toward lower stresses, and, to the extent that less material may be used, may provide a measure of lightening. It is thought that lower stresses in these features may tend to lead to a greater fatigue life. It may be noted that the panel 160 in which apertures 156 is formed is bounded on the inside by reinforcements. Bolster 24 may include a number of internal features. Starting at the mid-span centerline 27, there is a first lateral feature indicated as 160. A second lateral feature 162 is located in an inclined plane running from, roughly, the root of the transition of the lower flange (i.e. where mid-span portion 100 and inclined region 102 meet) of the center plate bowl rim 73 and the long axis 25 of symmetry of bolster 24 more generally. A third feature, indicated as 164, is a reinforcement feature extending in the long direction of bolster 24 on the underside of center plate bowl 74.

Feature 160 may include a substantially planar web member 166 that runs between sidewall portions 56 and 58 in a vertical plane, such as the mid-span plane or centerline 27, perpendicular to long axis 25 of bolster 24. Web member 166 may be joined along one upwardly extending edge or margin 168 to sidewall portion 56, and along another upwardly extending edge or margin to sidewall 58. Web member 166 may have feet 172 and 174 rooted in lower flange member 96, those feet bracketing a relief in the nature of an opening 176. Web member 166 may also have upper margins 178, 180 that merge into the underside of upper flange 72 in the region of center plate bowl 74. Web member 166 may also include, or support, a king pin socket fitting. That is, the king pin bore, namely accommodation 76, is formed downwardly through the base of center plate bowl 74, along the vertical, or z-axis, at the intersection of the longitudinal and transverse planes of symmetry of bolster 24. Accommodation 76 extends centrally into what would otherwise be the center of the mid-plane of web 166. However, web 166 has, in its upper region adjacent the base of center plate bowl 74 and reinforcement 164, two opposed bulges 184 that stand proud to either side of the rest of web 166. Bulges 184 surround bore 76 and co-operate to define the centerplate king pin socket. At the lower extremity of bulges 184 there is a penetration, or aperture 186 formed through web 166, to permit a cotter pin to be inserted through the tip of the king pin, thus discouraging its escape.

Feature 162 may be identified as a reinforcement or stiffener, and, in one embodiment, may have the form of a rib, vault or arch, having a first ascending portion 190 protruding inwardly of sidewall portion 56, and running from a root in lower flange member 96 fully upwardly to merge into a transversely extending upper portion 192 that protrudes downwardly from the substantially planar upper flange 72, that upper portion 192 having an arched lower curvature. Upper portion 192 also merges into a second ascending portion 194 that protrudes inwardly from sidewall portion 58. Second ascending portion 194 may be mounted symmetrically opposite to first ascending portion 190. First and second ascending portions 190 and 194, and upper portion 192 may co-operate to form an arch, and that arch may aid in the distribution of the relatively concentrated loads received at centerplate bowl 74 into the webs of the bolster, such as sidewall portions 56 and 58, and into the lower flange member 96.

It may be that rim 73 of center plate bowl 74 may be generally circular on the inside, but may include reinforced end portions as indicated at 185. Rim 73 may include squared-off lugs or corner portions 187, 189 such as may be thicker than the radial thickness of rim 73 elsewhere, such as at 91 at the mid-span centerline. The squared-off end portions may tend to run substantially parallel to upper portion 192 and may tend to be spread loads thereinto. The rectangular reinforced shape of these reinforced corner lugs may be of substantially the same width as the upper flange (+/−15%), and may have a length substantially the same as the outer diameter of rim 73 (+/−15%). The depth, or vertical thickness of the body of the lugs may correspond generally to the height of center plate bowl rim 73. That is, the thickness may be greater than about ½ the rim height, or half the center plate bowl depth, to about the same as the center plate bowl depth, or to about such thickness as make the top of the lugs, or corner portions 187, 189 tend to be flush with, or slightly shy of, the top surface of rim 73. The top of the corner lug portions may taper away from rim 73 and the taper may be relatively slight.

The members of feature 162 may define an opening, passage, or aperture 201 between a first chamber, sub-chamber, or space or cavity 200, and a second chamber, sub-chamber or cavity, 202. Cavity 200 may be bounded by features 160 and 162, upper flange 72, lower flange 96 and sidewall portions 56 and 58. It may be noted that bolster 24 may have a brake system dead lever fulcrum pad (and bolt fittings), indicated generally as 198, to which the brake arm dead lever 197 may be mounted. Pad 198 may be located near the top of sidewall 56 or 58, and may be such that the bolt fittings 161 straddle item 162, with the pad profile seating in line with item 162. Sub-chamber 202 lies outboard of feature 162 and is bounded by upper flange 72, lower flange 96 and sidewall portions 56 and 58. Sub-chamber 202 may extend along axis 25 to end at the narrows formed between web portions 148 and 150.

Feature 164 may be identified as a reinforcement or stiffener merging into and protruding downwardly from upper flange 72 under the base of the center plate bowl 74. Feature 164 may be termed a rib or a load spreader, and may have a narrow portion, or waist 203, adjoining feature 160, and may flare to a wider portion, or root 205, merging into the upper portion 192 of feature 162. When viewed as a whole, the opposed features 164 and feature 160 may, taken together, have a cruciate plan form, such as may tend to support or stiffen the base of the center plate bowl, with the arms of the cross-shaped reinforcement structure radiating from the axis of the center plate bore. The thickness, or depth, of feature 164 may be comparable to the thickness of upper flange 72 in the region of centerplate bowl 74 more generally. This thickness may be in the range of ½ to ⅔ the thickness of flange 72 at the base of the center plate bowl. The depth of feature 164 may be such as not to obstruct the passage opening defined by apertures 156 and 158.

As described, truck bolster 24 is a substantially hollow beam, having a generally box-shaped cross-section defined between the upper flange portion 52, the lower flange portion 54, and the first and second web portions. The box beam section so defined is one of varying depth and width. The internal reinforcements, such as items 160 and 162 are internal shear transfer reinforcements. These shear transfer reinforcements each have a force transfer connection to said first and second webs (the merging of the cross-wise web into the webs of the beam in the one case, and the merging of the column legs into the webs of the beam in the other), and another portion having a force transfer connection through which center plate bowl loads are received. The third internal reinforcement, feature 164, acts as a load carrying, or spreading rib that underlies and reinforces the centerplate bowl, while sharing its load between the top of the arch of feature 162 and the upper region of feature 160.

In the region of cavity 202, which is to say, that region of bolster 24 lying outboard of internal shear transfer reinforced 162, it may be that not only is there an absence of longitudinally running vertical shear webs linking top flange 72 with bottom flange 96, but, there may be an absence of longitudinally running ribs generally. This may tend to permit the use of a core for cavity 202 that is free of re-entrant features.

As noted above, bolster 24 may include brake rod apertures 156 and 158. Apertures 156 and 158 may be of non-standard size. The Association of American Railroads (AAR) standard S-392 provides standard dimensioning for brake rod apertures to accommodate a standard brake rod layout, and to accommodate a WABCOPAC or NYCOPAC brake arrangement. This standard S-392 is incorporated herein by reference. In general, the apertures provided for WABCOPAC or NYCOPAC brake arrangements have corner radii that are indicated as having a maximum radius of 2 inches. Standard brake rod openings are indicated as having corner radii of 2 inches. WABCOPAC brake rod openings are shown as having an area of the order of somewhat less than about 25 sq. in., maximum, and standard brake rod openings are shown as having an area of somewhat less than about 34 sq. in. Similarly, there may have been a tendency in the past to desire to minimize the size of the brake rod openings. These openings may not always tend to be overly generous in size, and the installation of the brake rods may sometimes tend to be a bit of a close fit. For example, one "conventional brake rod opening" identified in AAR standard S-392 has a generally parallelogram like shape being about 4⅝" wide, about 7⅛" high, and having corners with 2" radius and whose upper portion is offset laterally about 7/16". In another example standard S-392 shows a WABCOPAC brake rod opening that is generally rectangular, having a width of about 3⅛", a height of about 8⅝" and rounded corners having a radius that is, at most, 2". By contrast, apertures 156 and 158 may be rather larger. Apertures 156 and 158 may tend to employ rather larger radii of curvature in one, another, or all corners. Apertures 156 and 158 may tend to have a profile that encompasses both the standard brake rod profile and the WABCOPAC or NYCOPAC profile, such that either type of brake may be installed. Apertures 156 and 158 may tend to be more rounded than the standard and WABCOPAC or NYOPAC brake rod apertures identified in AAR standard S-392.

Aperture 156 (158 being substantially identical, but of opposite hand) is formed in a first panel region 204 of sidewall 56. First panel region 204 is bounded by upper flange 72, lower flange member 96, mid span transverse feature 160, and intermediate transverse feature 162. The profile of aperture 156 may be unusually large, and may provide increased space in which to install brake equipment. First panel region 204 may be thought of as being generally quadrilateral, having a first side or edge 210, being substantially horizontal, and adjacent to or associated with the edge of upper flange 72; a second side or edge 212, being substantially vertical, running along, or being associated with the edge of feature 160; a third side or edge 214, being predominantly horizontal, running along or being associated with, lower flange member 96; and a fourth side or edge 216 running along, or being associated with the inclined reinforcement feature 162. These associated sides and edges may meet at respective corners 211 (being the upper inboard corner between 210 and 212), 213 (being the lower inboard corner between 212 and 214), 215 (being the lower outboard corner between 214 and 216), and 217 (being the upper outboard corner between 216 and 210).

The profile of aperture 156 may be identified as 220. Profile 220 may have an overall height indicated as $h_{156}$, and an overall width indicated as $w_{156}$. Height $h_{156}$ may exceed ⅗ of the depth of bolster 24 measured over the top and bottom flanges namely items 72 and 96 (but excluding the height of the center plate bowl rim). In one embodiment, height $h_{156}$ may be in excess of ⅔ of this height. Expressed differently, $h_{156}$ may be greater than 10 inches, and may, in one embodiment, be about 10½ inches. Width $w_{156}$ may be of a magnitude greater than ⅖ of the magnitude of the overall height over the top and bottom flanges (i.e., items 72 and 96), and, in one embodiment, may be about half that height. In one embodiment $w_{156}$ may be in excess of 6½ inches. In another embodiment $w_{156}$ may be in excess of 7 inches. In another embodiment $W_{156}$ may be about 7⅞ inches (+⅛, −¼ inches). The aspect ratio of aperture 156 may be such that the ratio of width $w_{156}$ to height $h_{156}$ is in the range of about 3:5 to about 4:5, and, in one embodiment, it may be greater than about ⅔; and in another it may be about 3:4 (+/−10%). Profile 220 may have a perimeter arc length, P, and an enclosed area $A_{156}$. A characteristic dimension Dh, may be defined as $Dh=4A_{156}/P$. In one embodiment, Dh may be greater than 6½ inches, in another embodiment it may be greater than 7 inches, and in another embodiment may be greater than 8 inches. In one embodiment Dh may be about 9 inches. An equivalent circular diameter may be defined as Dc=square root of [4 A/π]. A measure of roundness of an aperture can be defined by the ratio of Dh to Dc. For a circular opening, this ratio of Dh/Dc is 100%. In one example, aperture 156 may have a ratio of Dh/Dc that is greater than 95%. In still another embodiment this ratio may be in the range of 97% or more, and 99% or less. A further measure of comparative roundness may be obtained by defining a characteristic diameter $Dp=(P/\pi)$ where π is approximately 3.1415926. In some embodiments, the ratio of Dh/Dp may be greater than 90%, in other embodiments may be greater than 15/16, and in one embodiment may be greater than 95%. As another measure of the unusual size and openness of aperture 156, area $A_{156}$ may be compared to the overall area, Ar, of region 204, as measured to the middle fibres of the bounding features 72, 96, 160 and 162. In one embodiment the ratio of $A_{156}$:Ar may be greater than 3/10, in another embodiment it may be greater than ⅜, and in one embodiment may be up to about 7/16 (+/−). In absolute terms, $A_{156}$ in some embodiments may be greater than 45 sq. in., in other embodiments may have an area of greater than 60 sq. in., and in one embodiment may have an area of greater than 65 sq. in. Alternatively, by comparison to the corresponding conventional brake rod opening defined in AAR S-392, $A_{156}$, may be half again as large, or more, than the corresponding WABCOPAC opening on one hand, or the corresponding conventional brake rod opening on the other, defined in S-392. In one embodiment, $A_{156}$ may be as much as, or more than, 80% larger in area than the corresponding conventional brake rod opening defined in S-392, and may be more than double the area of the corresponding WABCOPAC opening of S-392.

Profile 220 may include a number of corner radius regions. Those corner radius regions may include an upper inboard corner radius region 222, (such as may be associated with, or closest to, corner 211); a lower inboard corner radius region, 224, (such as may be associated with, or closest to, corner 213); a lower outboard corner radius region 226, (such as may be associated with or closest to, corner 215); and an upper outboard corner radius region 228, (such as may be associated with, or closest to, corner 217). Profile 220 may also include tangent portions between one or more pairs of two adjacent arcuate corner regions. By way of example, one tangent portion 230 may run between corner radius regions 222 and 224. Tangent portion 230 may be of substantial length, perhaps being as much or more than a quarter as long as the overall height, $h_{156}$, of aperture 156. Tangent portion 230 may run at an angle with respect to the vertical, and that angle may be such that the lower end of tangent 230 may be closer to item 160 than is the upper end. In one embodiment, tangent portion 230 may be between 4 and 5 inches in length. Tangent portion 230 may be the longest of any tangent portions of profile 220. Tangent portion 230 may be longer than the shortest radius of curvature of profile 220, but shorter than the largest radius of curvature. Profile 220 may also include a tangent portion 232 between corner radius regions 224 and 226 and another, or other tangent portions between regions 226 and 228; and between regions 228 and 222. There need not be tangent portions between each pair of radiused corner regions. In some embodiments, the curved portions of two corner portions may merge into one another at, for example a spline fit or mutually tangent point of slope continuity. Alternatively, the tangent portion between two arcuate portions may be of relatively short length, as for example, when the length of the tangent portion is between zero and about 1 or 1½ inches or so. In this context, the term "tangent point" is intended to include both true tangent intersections and joining tangent portions of small extent. For example, corner region 224 and corner region 226 may meet or be connected at or near the location indicated as 225, be it a common tangent point, or a joining tangent portion of small extent. Similarly, corner region 226 and corner region 228 may meet or be connected at or near the location indicated as 227, be it a common tangent point, or a joining tangent of small extent. Similarly too, corner region 228 and corner region 222 may meet or be connected at a common tangent point, or at a joining tangent of small extent.

It may be that each of the arcuate corner radius regions 222, 224, 226 and 228 has a predominant radius of curvature over a portion, or all, thereof. It is not necessary that these corner radii be formed on circular arcs. They could, for example, be formed on parabolic, elliptic, or hyperbolic arcs, or on a number of circular arcs of differing radii run (i.e., spline fit) into each other. However, as at least an approximation, these corner radius regions may be considered to have a dominant radius of curvature, or, where many radii of curvature are employed, or the radius of curvature varies as a function of arc length position, then the mean radius of curvature for the corner radius region. Those radii of curvature may be identified respectively as $R_{222}$, $R_{224}$, $R_{226}$ and $R_{228}$. Employing the dominant radius of curvature of the corner radius region, or the equivalent, or mean, radius of curvature of the section in the event that a parabolic, hyperbolic, or elliptic curve is employed, it may be that the radii of curvature of the corner regions differ. It may be, for example, that each corner region has a different radius of curvature. It may be that the dominant radius of curvature in the upper outboard corner may be the largest of the radii of curvature, identified as $R_{228}$. Expressed differently, it may be that the least sharply curved corner region of profile 220 may be the upper outboard region. It may be that the dominant radius of curvature of the upper outboard corner region is greater than half of Dh, and may be greater than half of Dc. In one embodiment, $R_{228}$ may be in the range of 6/5 to 5/3 as large as Dc. In one example the largest dominant corner radii, be it $R_{228}$, for example, may lie in the range of greater than 5 inches, and may be in the range of 5½ to 6½ inches, and in one embodiment may be about 6 inches. $R_{228}$ may be larger than the longest tangent portion of profile 220.

By contrast, the most sharply curved region of profile 220 may be in the upper inboard corner region, such that the smallest radius of curvature may be radius $R_{222}$. Radius $R_{222}$ may be more than 3/10 of Dh or Dc, and may be less than 2/5 of Dh or Dc. In one embodiment, $R_{222}$ may be more than 5/16 of Dc or Dh, and may be less than 3/8 of Dc or Dh. Expressed differently, the smallest dominant radius, such as may be $R_{222}$, may be more than 1/3 and of less than 3/5 of the largest dominant radius, such as $R_{228}$, for example, and in one embodiment may be more than 3/8 and may be less than half of the largest dominant corner radius. In one embodiment $R_{222}$ may be less than 3½ inches, and in another embodiment it may be less than 3 inches. In still another embodiment it may be about 2¾ inches. Any, or each of these radii, or all of them, may be larger than the 2" radius indicated in AAR S-392 for either the standard or WABCOPAC opening, and may be larger than 2½ inches.

In one embodiment, $R_{224}$ may be larger than $R_{222}$, and smaller then $R_{228}$. $R_{224}$ may be between 3 and 4 inches, and, in one embodiment may be about 3½ inches. $R_{224}$ and $R_{226}$ may be of roughly comparable size. $R_{226}$ may be somewhat larger than $R_{224}$, may be in the range of 3½ to 4½ inches, and in one embodiment may be about 3¾ inches (+/−½ inch).

The angular arcs of the respective corner portions need not necessarily be equal, and need not necessarily be 90 degrees. For example, corner portion 222 may extend over an arc in excess of 90 degrees. Corner portion 228 may extend over an arc of greater than 90 degrees. Corner portion 226 may extend over an arc of less than 90 degrees. The overall shape of profile 220 may be generally D-shaped, or kidney shaped. One side may include a straight edge of substantial extent, while the other side may have a predominantly bulging shape. Profile 220 may have an apex. That apex may be identified as 231. Profile 220 may also have a centroid, identified as $C_D$. Apex 231 may lie closer to the central vertical mid-span plane than the centroid. Expressed somewhat differently, apex 231 may be displaced laterally from tangent portion 230 a distance that is less than half the overall width of profile 220, and, in one embodiment, less than 3/8 of the width of profile 220, where the lateral displacement is measured perpendicular to tangent 230.

Leaving aside bores for mechanical fasteners, such as fittings 161 for the brake dead lever pad 198, sidewalls 56 and 58 may be substantially free of openings interrupting the web in the intermediate region 64 between reinforcement item 162 and a station lying abreast of the inboard edge of the side bearing seat 78 inboard of the end region 66. That is, particularly given the presence of a tool socket (i.e., relief 140) immediately abreast of, and adjacent to the bores 86, 88 of side bearing seat 78, sidewalls 56 and 58 may not require large intermediate openings, such as may be in the nature of access or lightening holes or penetrations, such as might otherwise permit a person to reach a hand or arm inside bolster 24 to install the nuts of the side bearing fittings. Expressed differently, to the extent that there is no penetration through either sidewall 56 or 58 to give access to the side bearing fitting, but only a web deviation, it may be that there is no lightening hole or access hole web penetration in webs 56 and 58 at all outboard of reinforcement 162 (and hence, outboard of aperture 156). As such, that region, identified as sidewall web panel 236 may be free of lightening or hand-access through hole openings.

Figure 3F:
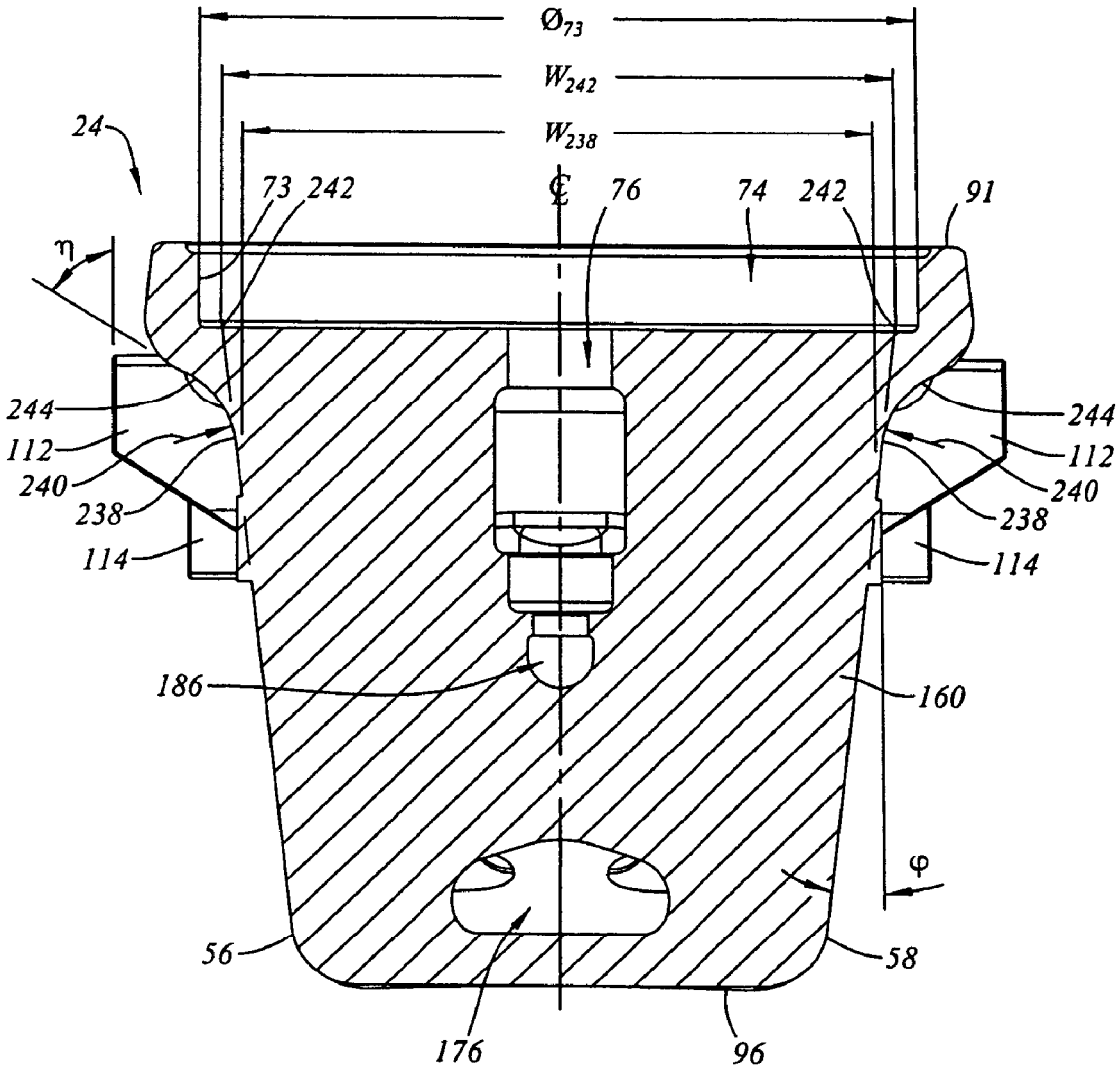
FIG. 3*f* is a cross-sectional view, in profile, on '3*f*-3*f*' of FIG. 2*b* taken in the mid-span vertical plane of the truck.

Considering the section '**3*f*-3*f*', it may be noted that sidewall portions 56 and 58 may not necessarily stand in a vertical plane in the region of item 160. Rather, they may be inclined outwardly at an angle, designated in the illustrations as angle $\phi$, being wider apart at the top than at the bottom. The overhang of the center plate bowl rim at the mid-span section, as shown, for example, in FIG. 3*f*, may then tend to be reduced. This can be seen in a number of ways. For example, taking the width $W_{238}$ between the points of tangency 238 of the upper radii 240 as a proportion of the inside diameter of the center plate bowl, $W_{238}$ may be in the range of 85 to 100% of that diameter, and in one embodiment may be in the range of 87 to 92% of that value. Alternatively, if construction lines are drawn from the tangent of the slope of the web on the mid-span centerline to intersect the bottom wall of the center plate at a location 242 (or the top surface of the base portion of the center-plate liner, if one is used) the width at that intersection, identified as $W_{242}$ may, in one embodiment be more than 7/8 of the center plate bowl inside diameter, and, in one embodiment may be more than 90% of the center plate bowl inside diameter. A third way of observing this is in the angle $\eta$ from the vertical of the point of tangency 244 of the radius on the underside of the center plate bowl on the mid-span section, as seen in FIG. 3*f* for example. In a conventional truck bolster, this angle may be roughly 90 degrees. This angle may be less than 75 degrees, and in one embodiment may be about 60 to 70 degrees, and may yield a distinctly less sharp transition from the center plate bowl to the web at that location. It may be that while upper flange 72 is widening from the juncture with center plate bowl 74, bottom flange 96 may be narrowing from the mid-span centerline to a location generally abreast of the inboard gibs 112**.

Considering the inside of truck bolster 24, it may be that bolster 24 is substantially free of longitudinally running vertical webs such as might other wise extend between, and connect, bottom flange 96 and top flange 72 in either the deep bay of sub cavities 200 under centerplate bowl 74, or in the next adjacent bay of sub-cavity 202 between feature 162 and the inboard gib or side bearing location. That is, in these locations, rather than having internal, longitudinally running full height shear web panels, truck bolster 24 may tend to have comparatively large open cavities, namely 200 and 202. Bolster 24 may be free of such vertical webs running along the long centerline, and may also be free of pairs of such vertical webs, spaced symmetrically to either side of the long centerline.

Furthermore, outboard of the station of side bearing seat 78, in contrast to more conventional designs in which the bolster end may include vertical internal webs running longitudinally, truck bolster 24 may have a sub-cavity 250. That is, between the stations of the inboard and outboard gibs 112 and 114, or, alternatively put, outboard of the station of inboard gibs 112, truck bolster 24 may have a lengthwise continuous cavity namely sub-cavity 250. That cavity, when viewed in the sectional plan view of FIG. **2*c*, for example, may run behind the bolster pockets, and may have a generally hour-glass shape, such that each of the sidewalls is spaced a first distance $\epsilon_1$ from the truck bolster centerline generally abreast of the inboard gib 112, a second distance $\epsilon_2$ at the outboard end adjacent the outboard gib 114, and a third distance $\epsilon_3$ at an intermediate location between the inboard and outboard gibs, that third distance $\epsilon_3$ being less than either the first distance $\epsilon_1$ or the second distance $\epsilon_2$. In some embodiments $\epsilon_1$ and $\epsilon_2$ may be the same, or substantially the same. The location of the minimum distance, $\epsilon_2$, may be mid way between the inboard and outboard gibs 112 and 114, and may be between the inboard and outboard bolster pockets 120 and 122. The location of the minimum distance may lie over the center of the upper spring seat pattern, that location being exactly mid way between the inboard and outboard bolster pockets 120 and 122. Over this distance, the sub-cavity 250, in plan view, is free from sharp changes in section width, and is free of small radii of curvature. It may be noted that passage 146 connects sub-cavity 250 with the adjacent sub-cavities 200 and 202 in the central bay between feature 160 and feature 162, and in the next adjacent bay between feature 162 and the location of the inboard gib 112. To the extent that these bays are in continuous fluid communication, and to the extend that feature 160 has a through aperture, such as relief 176, all of the sub-cavities are interconnected, and in those embodiments in which truck bolster 24** is a steel casting, the number of casting cores required my be reduced, as compared to the number of cores that may previously have been employed in other truck bolsters; and the cores may be interlinked, or joined together such that there may be more precise control over the positioning of the cores in the bolster mold, both of one core relative to another, and of the cores themselves relative to the mold. It is thought that this may tend to encourage or permit more consistent reproduction, or production to closer tolerances from one truck bolster casting to the next.

Figure 4B:
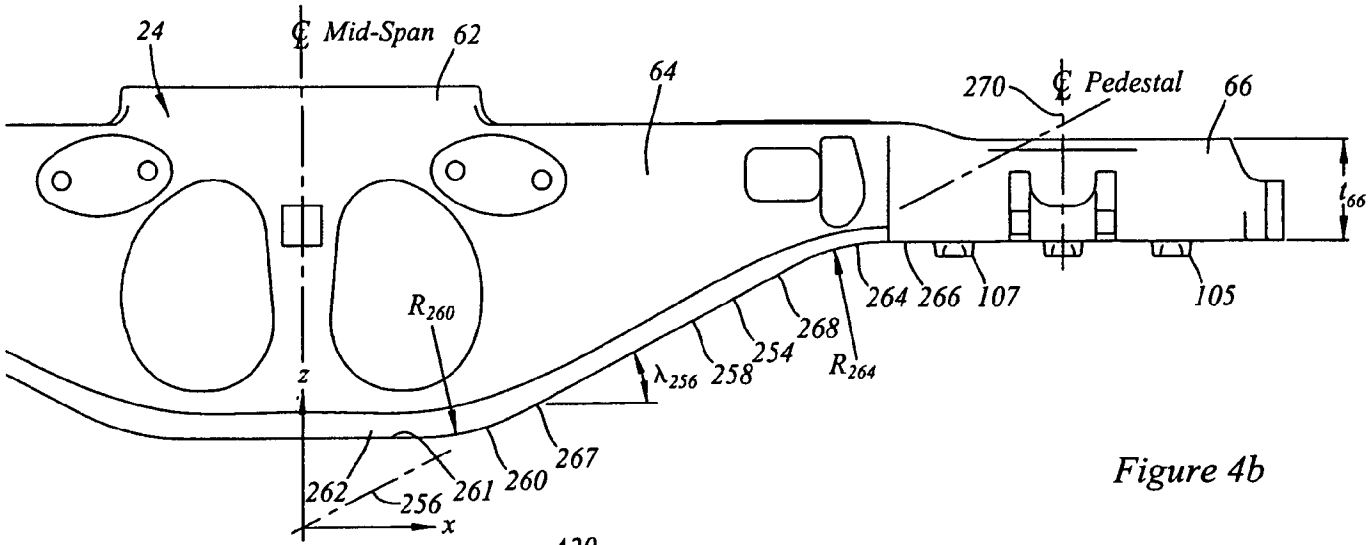
FIG. 4*b* shows the truck bolster of FIG. 2*a* in a profile contrasting with that of FIG. 4*a*.
Figure 4A:
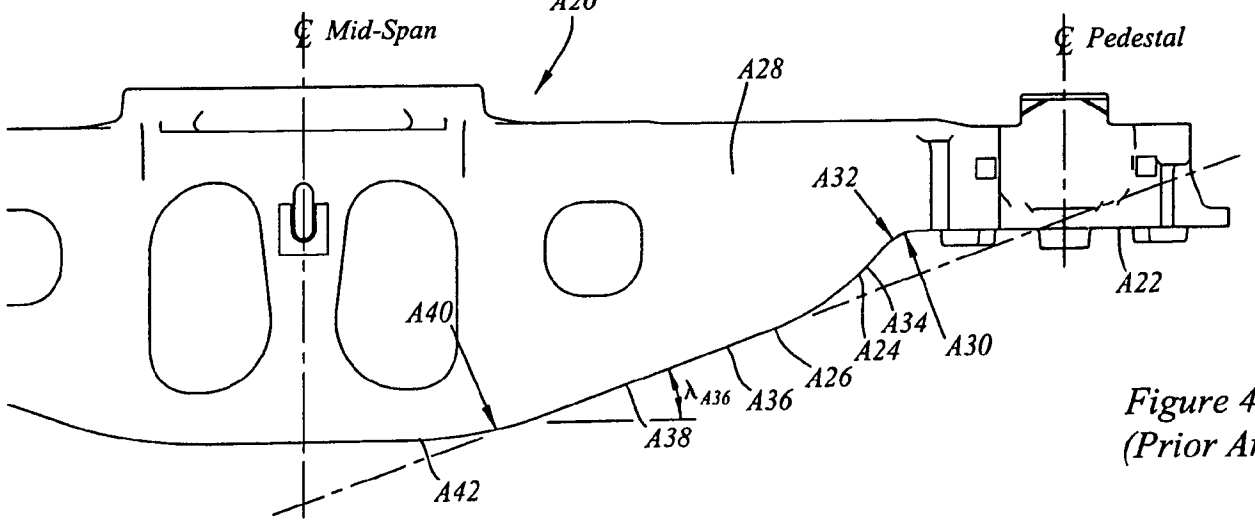
Figure 4a (Prior Art)
FIG. 4*a* shows a prior art truck bolster in profile.

Some known truck bolsters, such as the Barber S2-HD, may have a profile generally similar to that shown in FIG. 4*a*. In this bolster A20, the bottom flange transition A24 from the bottom flange end portion A22 of bolster A20 to the inclined portion A26 of the tapering intermediate portion A 28 of bolster A20 includes a relatively small radius first curve, A30, whose center of curvature lies below the bottom flange, and then a second curve A32, having a center of curvature lying above the bottom flange. There is a point of inflection A34 between the two curves, and a sloped, or tangential, portion A36 running on the slope of the deepening transition section A38. The angle of this slope from the horizontal is identified as 36. There is a further radius of curvature A40 where the transition section meets the deep central portion of the bolster A42, the center of curvature of radius A40 lying above the bottom flange.

A smoother, gentler transition may tend to yield a stress field in the flange that is subject to less sharply changing stress field gradients. In that light, referring to FIG. 4*b*, in one embodiment, truck bolster 24 may have a relatively smooth, large radius transition at the junction of the tapered region 64 or portion of bolster 24 to the end region 66 or portion. This may be expressed in a number of ways. First, the sloped portion 254 of lower flange 96 may lie on a tangent plane 256, as viewed in profile, tangent plane 256 lying at an inclined angle $\lambda_{256}$ relative to the horizontal. It may be that the generally downwardly facing surface 258 of sloped portion 254 of bottom flange 96 is substantially planar, in whole or in part, that plane extending perpendicular to long axis 25 of truck bolster 24 on the incline of angle $\lambda_{256}$. The radius of curvature $R_{260}$ of the arcuate corner portion 260 of the outside fibre of the bottom flange 96 between deep central portion 262 and sloping portion 254 has a center of curvature lying above plane 256. It may be that arcuate portion 260 is tangent at its ends to the substantially horizontal central bottom flange portion 262 (at location 261), and to sloped portion 254 (at location 267) respectively. It may be that over this arcuate portion 260, both the first and second derivatives (i.e., dz/dx, and $d^2z/dx^2$) of the curve are positive. At the outer, upper end of sloped portion 254, there may be another arcuate portion, 264, that may be formed on a radius of curvature identified as $R_{264}$, having a center of curvature lying below plane 256. It may be that arcuate portion 264 is tangent at its respective inboard and outboard ends to sloped portion 254 and end portion 266 of bottom flange 96. It may be that over this arcuate portion 264, the first derivative, dz/dx, is decreasingly positive, and the second derivative, $d^2z/dx^2$, is negative.

In contrast to the design of FIG. 4*a*, the transition from the sloped portion to the end portion may be free of the third radius of curvature, or, expressed differently, may be free of any portion for which the second derivative, $d^2z/dx^2$ is positive. Expressed differently again, bolster 24 may be such that the profile of the bottom flange outboard of planar sloped portion 254 (i.e., outboard of the end point of the tangent section, indicated at 268), does not include any portion extending upwardly of plane 256. The radius of curvature $R_{264}$ at the junction of inclined portion 254 of lower flange 96 and the end portion 266 of lower flange 96 may be greater than the vertical through thickness $t_{66}$ of the end portion 66 of bolster 24 on centerline 25 at the station of the middle of the upper spring seat 107, which, when the bolster is at rest in a neutral position may tend to coincide with the centerline of the side frame pedestals, indicated as 270. In one embodiment, radius $R_{264}$ may be greater than 4 inches. In another embodiment, $R_{264}$ may be greater than 6 inches. In another embodiment $R_{264}$ may be in the range of 6 to 15 inches. In another embodiment, $R_{264}$ may be in the range of 8 to 12 inches. In another embodiment, $R_{264}$ may be about 9½ inches (+/−1 inch). Expressed yet differently again, that radius, $R_{264}$, may be greater than 4 inches, and may be greater in magnitude than half of the main radius of curvature $R_{260}$ between the deep central portion and the inclined portion. In one embodiment the ratio of $R_{264}$:$R_{260}$ may lie in the range of 1:3 to 6:5, and may in one embodiment be in the range of 1:2 to 9:10. In one embodiment $R_{260}$ may be about 12 inches (+/−20%). In one embodiment $R_{264}$ may be about 9½ inches (+/−20%). Expressed yet differently again, in one embodiment, all of the spring seat retainers 105 may lie below the inclined plane 256, or more simply, the entire upper spring seat 107 may lie below plane 256. It may also be that in one embodiment, the slope of the incline, namely angle $\lambda_{256}$ may be greater than 20 degrees from the horizontal. In another embodiment $\lambda_{256}$ may be greater than 23 degrees. In another embodiment, $\lambda_{256}$ may be about 27 degrees (+/−2 degrees).

In an alternate embodiment, tangential, sloped portion 254 of the bottom flange 96 may be very short, or, may be of zero length. That is, the arcuate portions 260 and 264 may be formed to meet at a common point of inflection (i.e., the distance between points 267 and 268 decreases to zero). In such case, plane 256 may be defined as being the plane that is normal to the second derivative, $d^2z/dx^2$, of either arcuate portion at the point of inflection, those second derivatives being defined as collinear at the point of inflection.

While bolster 24 may be used in trucks of various sizes and capacities, it may be that it may be employed in a truck of an AAR rated capacity of at least 70 Tons. Alternatively, it may be employed in trucks of at least 100 Tons rating. In the further alternative, it may be used in trucks having an AAR rating of either 110 Tons or 125 Tons. Expressed somewhat differently, bolster 24 may be rated to carry a central vertical load of at least 115,000 lbs. In another embodiment, bolster 24 may be rated to carry a vertical load of at least 130,000 lbs.

In still another embodiment, bolster 24 may be rated to carry a load of at least 145,000 lbs.

Various embodiments have been described in detail. Since changes in and or additions to the above-described examples may be made without departing from the nature, spirit or scope of the invention, the invention is not to be limited to those details.

We claim:

1. A truck bolster for a railroad freight car truck, wherein:

said truck bolster is a casting; and said truck bolster includes a beam having an upper flange portion, a lower flange portion, a first web portion and a second web portion, said upper and lower flange portions and said first and second web portions being outside walls of said beam defining a hollow box section;

said beam having a deep central region, shallow first and second ends for mounting to rail road car truck side-frames, and intermediate regions extending between said deep central region and said shallow ends, said upper flange portion running lengthwise between said ends;

a centerplate bowl located at mid-span between said first and second ends, said centerplate bowl surmounting said deep central region;

said beam having brake rod openings formed in said first web portion and said second web portion in said deep central region of said beam to permit brake rods to extend through said beam;

a shear transfer reinforcement mounted cross-wise within said beam substantially centrally under said centerplate bowl, a first portion of said shear transfer reinforcement being mounted to receive downward forces from said centerplate bowl, a second portion of said shear transfer reinforcement having a shear force transfer connection to said first web portion, and a third portion of said shear transfer reinforcement having a shear transfer connection to said second web portion; and in said deep central region, said beam is free of lengthwise extending internal vertical shear webs joining said upper flange portion to said lower flange portion intermediate said outside walls of said beam.

2. The truck bolster of claim 1 wherein said shear transfer reinforcement is a web mounted cross-wise within said beam.

3. The truck bolster of claim 2 wherein said web is mounted diametrically under said centerplate bowl.

4. The truck bolster of claim 3 wherein said web has an accommodation formed therein for receiving a centerplate pin.

5. The truck bolster of claim 2 wherein said centerplate bowl includes a stiffening rib running lengthwise thereunder, and protruding downwardly therefrom, said stiffening rib intersecting said shear transfer reinforcement web.

6. The truck bolster of claim 5 wherein said stiffening rib flares laterally from a narrow portion where said stiffening rib intersects said shear transfer reinforcement web to a wider portion lengthwise outboard thereof.

7. The truck bolster of claim 1 wherein said truck bolster is also free of lengthwise extending internal vertical shear webs connecting said upper flange portion to said lower flange portion in said intermediate regions of said beam.

8. The truck bolster of claim 1 wherein:

said shear transfer reinforcement is a first internal shear transfer reinforcement;

said first internal shear transfer reinforcement is a cross-wise web standing in a vertical plane at a mid span plane of symmetry of said centerplate bowl;

and said truck bolster includes a second internal shear transfer reinforcement, said second internal shear transfer reinforcement being a cross-wise archway spaced outboard from said first internal shear transfer reinforcement;

said cross-wise archway having a first leg rooted in said first web portion, a second leg rooted in said second web portion, and an upper portion running under said upper flange portion between said legs.

9. The truck bolster of claim 8 wherein a depending centerplate reinforcement rib runs length-wise from said upper portion of said archway to an upper region of said cross-wise web.

10. The truck bolster of claim 1 wherein said shallow ends of said bolster have upper spring seats for engaging an upper end of a spring group, said shallow ends having a through-thickness depth as measured centrally at said upper spring seat; said lower flange portion has a transition between each said intermediate region and a respective one of said ends adjacent thereto; and, in said transition, said lower flange portion has a minimum radius of curvature that is at least as great as said through thickness depth.

11. The truck bolster of claim 10 wherein said ends of said truck bolster are free of lengthwise internal webs.

12. The truck bolster of claim 1 wherein:

said lower flange portion of said beam includes an ascending portion of said intermediate region next adjacent to said deep central region that ascends lengthwise outboard and upward on a tangent slope; and said ascending portion of said lower flange portion of said beam merges into an end portion of said lower flange portion of one of said ends of said beam at a transition, said transition being free of deviation above said tangent slope.

13. The truck bolster of claim 1 wherein said upper flange portion has an upper surface, said truck bolster has side bearing seats defined on said upper surface, and said truck bolster has side bearing fitting access sockets formed therein abreast of said side bearing seats.

14. The truck bolster of claim 1 wherein said upper flange portion has an upper surface, said truck bolster has side bearing seats defined on said upper surface, and said web portions of said truck bolster have deviations therein abreast of said side bearing seats, said deviations defining side bearing fitting access sockets.

15. The truck bolster of claim 1 wherein:

said brake rod openings are located generally beneath said centerplate bowl; and said first and second web portions are free of tool access openings outboard of said brake rod openings.

16. A truck bolster for a railroad freight car truck, wherein:

said truck bolster is a casting; and said truck bolster includes a beam having an upper flange portion, a lower flange portion, a first web portion and a second web portion, said upper and lower flange portions and said first and second web portions being outside walls of said beam defining a hollow box section;

said beam having a deep central region, shallow first and second ends for mounting to rail road car truck side-frames, and intermediate regions extending between said deep central region and said shallow ends, said upper flange portion running lengthwise between said shallow ends;

a centerplate bowl located at mid-span between said shallow first and second ends, said centerplate bowl surmounting said deep central region;

said beam having brake rod openings formed in said first web portion and said second web portion in said deep central region of said beam to permit brake rods to extend through said beam;

a shear transfer reinforcement mounted cross-wise within said beam substantially centrally under said centerplate bowl, a first portion of said shear transfer reinforcement being mounted to receive downward forces from said centerplate bowl, a second portion of said shear transfer reinforcement having a shear force transfer connection to said first web portion, and a third portion of said shear transfer reinforcement having a shear transfer connection to said second web portion;

said shear transfer reinforcement is a first shear transfer reinforcement, and said bolster includes a second shear transfer reinforcement mounted cross-wise within said beam, said second shear transfer reinforcement being located outboard of said first shear transfer reinforcement and outboard of said brake rod openings, said second shear transfer reinforcement being connected to said upper flange portion and to said first and second web portions.

17. The truck bolster of claim 16 wherein said second shear transfer reinforcement is an archway.

18. The truck bolster of claim 17 wherein said archway has an apex near to said centerplate bowl, and said archway has legs extending away from said apex, said legs providing load paths into said first and second web portions of said beam.

19. The truck bolster of claim 18 wherein said archway inclines at an angle from vertical.

20. The truck bolster of claim 17 wherein said truck bolster is free of longitudinally running, upwardly standing webs underneath said archway.

21. A truck bolster for a railroad freight car truck, said truck bolster comprising:

a casting in the form of a beam, said beam having an upper flange portion, a lower flange portion, a first web portion and a second web portion, when seen in a cross-section taken cross-wise in said bolster said upper and lower flange portions extending predominantly horizontally, and said web portions extending predominantly up-and-down between said flange portions;

said upper and lower flange portions and said first and second web portions being outside walls of said beam defining a hollow box section;

said beam having a deep central region, shallow first and second ends defining upper spring seats for main spring groups of the railroad car truck, and intermediate regions extending between said deep central region and said shallow first and second ends;

said upper flange portion running lengthwise between said ends;

a centerplate bowl surmounting said deep central region at mid-span between said first and second ends;

a shear transfer reinforcement mounted cross-wise within said beam substantially centrally under said centerplate bowl, said shear transfer reinforcement being operable to transmit vertical loads from said centerplate bowl into said first and second web portions; and said truck bolster has first and second brake rod openings formed in said first web portion and said second web portion respectively in said deep central region of said beam to permit brake rods to extend through said beam;

said first brake rod opening of said truck bolster has an area, A, a perimeter P, and a first characteristic dimension Dh, Dh being calculated according to the formula $Dh=4A/P$; and said bolster satisfies any one of the set of conditions consisting of (a) a first condition, wherein Dh is greater than 6½ inches;

(b) a second condition, wherein said first brake rod opening has a second characteristic dimension, Dp, Dp being calculated according to the formula $Dp=(P/\pi)$; and a ratio of Dh/Dp lies in the range of 0.9 to 1.0; and (c) a third condition, wherein said first brake rod opening has a second characteristic dimension, Dc, Dc being calculated according to the formula Dc=the square root of $[4A/\pi]$; and a ratio of Dh/Dc lies in the range of 0.95 to 1.0.

22. The truck bolster of claim 21 wherein said first brake rod opening area, A, is at least 50% greater than the largest corresponding brake rod opening defined in AAR standard S-392, as that standard read on Jan. 1, 2005, and identified as "conventional brake rod opening".

23. The truck bolster of claim 22 wherein said area A of said first brake rod opening exceeds by more than 80% the area of the largest brake rod opening defined in AAR standard S-392 as that standard read on Jan. 1, 2005.

24. The truck bolster of claim 21 wherein said first brake rod opening perimeter is free of any radius of curvature of less than 2½ inches.

25. The truck bolster of claim 24 wherein said first brake rod opening has a radiused corner having a radius of more than 5 inches.

26. The truck bolster of claim 21 wherein AAR standard S-392 as it read on Jan. 1, 2005 defines a corresponding "conventional brake rod opening", AAR standard S-392 as it read on Jan. 1, 2005 defines a corresponding "WABCOPAC" brake rod opening, and said perimeter of said first brake rod opening of said truck bolster encompasses both said "conventional brake rod opening" and said "WABCOPAC" brake rod opening.

27. The truck bolster of claim 21 wherein said area, A, of said first brake rod opening of said truck bolster is greater than 40 sq. in.

28. The truck bolster of claim 21 wherein Dh is greater than 8 inches.

29. The truck bolster of claim 21 where the ratio Dh/Dp is greater than 0.94.

30. A truck bolster of a railroad freight car truck, said truck bolster being a casting, wherein said truck bolster comprises:

a hollow beam having shallow first and second ends for mounting to sideframes, said truck bolster having a lengthwise direction running between said first and second ends, said beam having a deep central region, and intermediate regions extending between said deep central region and said shallow first and second ends;

said hollow beam having an upper flange portion, a lower flange portion, a first web portion and a second web portion, said upper and lower flange portions and said first and second web portions being outside walls of said beam co-operating to define a box section;

a centerplate bowl located at mid-span between said first and second ends;

said centerplate bowl surmounting said deep central region;

said beam having brake rod openings formed in said first web portion and said second web portion in said deep central region of said beam to permit brake rods to extend through said beam;

an internal shear web mounted cross-wise relative to said lengthwise direction, said internal shear web being mounted to reinforce said centerplate bowl, said internal shear web extending from said centerplate bowl to said lower flange portion, and from said first web portion to said second web portion; and said internal shear web being located at a lengthwise station of said beam lying inboard of said brake rod openings;

additional shear transfer reinforcements located longitudinally outboard to either side of said internal shear web, and outboard of said brake rod openings in said first and second web portions defining outside walls of said beam;

said additional shear transfer reinforcements being internal arches oriented cross-wise in said beam, said arches having an upper portion protruding downwardly of said upper flange portion, and respective legs extending downwardly thereof merging into said first and second web portions defining outside walls of said beam.

31. The truck bolster of claim 30 wherein said internal shear web extends diametrically beneath said centerplate bowl.

32. The truck bolster of claim 30 wherein said internal shear web has an accommodation for a centerplate pin formed therein.

33. The truck bolster of claim 30 wherein said internal shear web has feet merging into said lower flange portion, and a relief defined adjacent to said lower flange portion between said feet.

34. The truck bolster of claim 30 wherein said bolster has a longitudinally running centerplate reinforcement rib, and said rib intersects said internal shear web.

35. A railroad freight car truck bolster, said truck bolster being a casting, said truck bolster comprising:

a hollow beam having first and second ends for mounting in a rail road car truck sideframes;

a centerplate bowl mounted in a mid-span position between said first and second ends;

brake rod apertures formed in said beam, said brake rod apertures being located generally beneath said centerplate bowl; and said hollow beam having an upper flange, a lower flange, and predominantly upwardly standing first and second webs extending between said upper and lower flanges; and said first and second webs being free of hand access openings outboard of said brake rod apertures.

36. The railroad freight car truck bolster of claim 35 wherein side bearing seats are defined on said upper flange of said truck bolster, side bearing fitting access sockets are defined in said webs abreast of said side bearing seats, and said webs are substantially planar between said brake rod apertures and said sockets.

37. The railroad freight car truck bolster of claim 35, wherein said upper flange of said bolster has side bearing seats defined thereon, and said bolster has attachment fittings for said side bearing seats; and side bearing fitting access pockets are formed in said beam abreast of said side bearing seats.

38. The truck bolster of claim 37 wherein said sidebearing seats are defined on said upper flange, and said pockets are formed in said webs.

39. The truck bolster of claim 38 wherein a wall of one of said pockets is formed by a deviation formed in one of said webs.

40. The truck bolster of claim 37 wherein said attachment fittings include two spaced apart bores formed through said upper flange, said bores having centerlines, and at least a portion of one of said webs passes between said centerlines of said bores.

41. A truck bolster for a railroad freight car, said bolster being a casting and having a rating of at least "100 Tons", wherein:

said bolster has a top flange, a bottom flange, and webs extending between said top and bottom flanges, said flanges and said webs co-operating to define a hollow beam;

said beam having a first end portion and a second end portion, said end portions being for seating upon spring groups in sideframe windows of respective railroad freight car truck sideframes;

said beam having a central portion;

said central portion being deep and said first and second end portions being shallow;

said bottom flange including a central portion and first and second end portions, said central portion of said bottom flange being part of said central portion of said beam, and said first and second end portions of said bottom flange being parts of said first and second end portions of said beam respectively;

said bottom flange including first and second intermediate portions;

said first intermediate portion of said bottom flange extending between said central portion of said bottom flange to said first end portion of said bottom flange;

said second intermediate portion of said bottom flange extending between said central portion of said bottom flange and said second end portion of said bottom flange;

said first intermediate portion of said bottom flange meeting said central portion of said bottom flange at an inboard transition, said bottom flange next adjacent to said inboard transition extending upwardly and outwardly from said inboard transition in an upwardly and outwardly ascending inclined plane;

said first intermediate portion of said bottom flange merging into said first end portion of said bottom flange at an outboard transition; and said bottom flange being free of any deviation extending inboard and upward of said inclined plane adjacent to said outboard transition.

42. A truck bolster for a railroad freight car, said bolster being a casting and having a rating of at least "100 Tons", wherein:

said bolster has a top flange, a bottom flange, and webs extending between said top and bottom flanges, said flanges and said webs co-operating to define a hollow beam;

said beam having a deep central portion for location beneath the centerplate of a railroad car body and shallower end portions for location on top of spring groups in a sideframe window of railroad car truck sideframe;

said bottom flange including first and second portions ascending outboard from said deep central portion to said end portions;

said bottom flange having a first transition from said deep central portion to each said ascending portion, and a second transition from each said ascending portion to each said end portion, respectively;

said first transition having a first radius of curvature, $R_1$, and a center of curvature thereof lying generally upward of said first transition;

said second transition having a second radius of curvature, $R_2$, and a center of curvature lying generally downward of said second transition; and $R_2$ is at least one half of $R_1$.

* * * * *